US011496819B2

(12) United States Patent
Han et al.

(10) Patent No.: US 11,496,819 B2
(45) Date of Patent: Nov. 8, 2022

(54) ELECTRONIC DEVICE INCLUDING SPEAKER MODULE

(71) Applicant: Samsung Electronics Co., Ltd., Suwon-si (KR)

(72) Inventors: Brian Han, Suwon-si (KR); Kwanghyun Kim, Suwon-si (KR); Jiwoo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/185,143

(22) Filed: Feb. 25, 2021

(65) Prior Publication Data

US 2021/0368251 A1 Nov. 25, 2021

(30) Foreign Application Priority Data

May 22, 2020 (KR) ..... 10-2020-0061383

(51) Int. Cl.
*H04R 1/02* (2006.01)
*H04R 1/32* (2006.01)

(52) U.S. Cl.
CPC ..... *H04R 1/026* (2013.01); *H04R 1/323* (2013.01)

(58) Field of Classification Search
CPC ..... H04R 1/026; H04R 1/323
See application file for complete search history.

(56) References Cited

U.S. PATENT DOCUMENTS 7,130,436 B1 * 10/2006 Tabata ..... H04R 1/1008 310/327
8,912,913 B2 * 12/2014 Martins ..... G06F 1/1616 340/686.1
2009/0325653 A1 12/2009 Kim et al.
2011/0188676 A1 8/2011 Momose et al.
2012/0183170 A1 * 7/2012 Chen ..... H04R 9/025 381/386
2017/0303033 A1 10/2017 Shao et al.
(Continued)

FOREIGN PATENT DOCUMENTS

JP 2008-244908 A 10/2008
JP 2011-160325 A 8/2011
(Continued)

OTHER PUBLICATIONS

International Search Report dated May 14, 2021, issued in International Application No. PCT/KR2021/001536.

*Primary Examiner* — Andrew L Sniezek
(74) *Attorney, Agent, or Firm* — Jefferson IP Law, LLP

(57) ABSTRACT

An electronic device is provided The electronic device includes a first case member, a plurality of protruding members provided on the first case member or a supporting member disposed on the first case member, at least one speaker, an enclosure configured to receive at least a portion of the speaker and including a plurality of receiving recesses formed in a side surface of the enclosure, and engaging members engaged to the enclosure and at least partially positioned in the receiving recesses, respectively. The engaging members may be engaged to one of the plurality of protruding members, respectively, to fix the enclosure to the first case member or the support member disposed on the first case member. Other various embodiments are possible as well.

25 Claims, 14 Drawing Sheets

(56) References Cited

U.S. PATENT DOCUMENTS

| | | | | |
|---|---|---|---|---|
| 2017/0374445 | A1 | 12/2017 | Choi et al. | |
| 2019/0041909 | A1* | 2/2019 | Pakula | H04N 5/2258 |
| 2019/0356983 | A1 | 11/2019 | Han et al. | |
| 2020/0110444 | A1* | 4/2020 | Jia | H04M 1/0268 |

FOREIGN PATENT DOCUMENTS

| | | | |
|---|---|---|---|
| KR | 10-2006-0016944 | A | 2/2006 |
| KR | 20-0443432 | Y1 | 2/2009 |
| KR | 10-2010-0062078 | A | 6/2010 |
| KR | 10-1039639 | B1 | 6/2011 |
| KR | 10-2014-0004875 | A | 1/2014 |
| KR | 10-1790528 | B1 | 11/2017 |
| KR | 10-2019-0132732 | A | 11/2019 |

* cited by examiner

ELECTRONIC DEVICE INCLUDING SPEAKER MODULE

CROSS-REFERENCE TO RELATED APPLICATION(S)

This application is based on and claims priority under 35 U.S.C. § 119(a) of a Korean patent application number 10-2020-0061383, filed on May 22, 2020, in the Korean Intellectual Property Office, the disclosure of which is incorporated by reference herein in its entirety.

BACKGROUND

1. Field

The disclosure relates to an electronic device, e.g., an electronic device with a speaker module. More particularly, the disclosure relates to a speaker module capable of securing a sufficient resonance space even in a compact space, a mounting structure thereof, and/or an electronic device including the same.

2. Description of Related Art

In general, the term 'electronic device' may be used to encompass devices that enables use of communication functions, such as a voice call or a short message transmission, multimedia functions, such as music or video playback, and entertainment functions, such as playing game. Compact electronic devices, such as smart phones are easy to carry, and have integrated functions of communication functions, multimedia functions, and/or entertainment functions and thus come in wide use.

A desktop computer used in a home or office may be easy to equip with additional hardware, and thus, additional functions. In general, since a desktop computer needs connection to a separate output device (e.g., a monitor or speaker) and an input module (e.g., a keyboard or mouse), the desktop computer may be less portable. Despite some limitations in addition or expansion of functions or performance compared to a desktop computer, the laptop computer may be highly portable because it already comes with an output device and an input module. For example, the laptop computer may be installed or placed in a smaller space than the desktop computer and may be easy to carry and store.

The above information is presented as background information only to assist with an understanding of the disclosure. No determination has been made, and no assertion is made, as to whether any of the above might be applicable as prior art with regard to the disclosure.

SUMMARY

Laptop computers may gradually replace desktop computers in a variety of areas, such as learning or entertainment applications as well as for office use. As laptop computers come in wider use and become commonplace for everyday use, user demands for the performance and emotional quality of laptop computers may increase. For example, a user may request an electronic device with improved portability and screen quality or sound quality. Screen quality may be improved through the specifications of the display and the performance of the image signal processor (or video signal processor). For example, in the same display size, the screen quality may have no or little influence on the portability of the laptop computer. In order to improve sound quality, a sufficient resonance space may be required in the speaker module, and the larger the resonance space, the easier sound tuning and richer volume may be provided.

However, as the resonance space of the speaker module increases, the portability of an electronic device (e.g., a laptop computer) may decrease. For example, improving sound quality may be an obstacle to slimming down the electronic device. On the other hand, a compact electronic device may have difficulty in securing a sufficient resonance space for the speaker module. Due to a structure for mounting or fastening the speaker module inside a compact electronic device, the secured resonance space may be reduced relative to the space occupied by the speaker module. In delivering rich volume and a wide bandwidth of sound by securing a sufficient resonance space for the speaker module (e.g., when the low band sound is reinforced), mechanical vibration that arises when the sound is output may be delivered to the structures of the electronic device or the user. For example, when the speaker module has a sufficient resonance space, the compact electronic device may suffer from noise due to mechanical vibration.

Aspects of the disclosure are to address at least the above-mentioned problems and/or disadvantages and to provide at least the advantages described below. Accordingly, an aspect of the disclosure is to provide a speaker module capable of securing a sufficient resonance space even in a compact space, a mounting structure thereof, and/or an electronic device including the same.

Another aspect of the disclosure is to provide a speaker module which contributes to enhanced sound quality by securing a sufficient resonance space, a mounting structure thereof, and/or an electronic device including the same.

Another aspect of the disclosure is to provide a speaker module capable of suppressing or preventing vibration generated during sound output from being transmitted to other surrounding structures, a mounting structure thereof, and/or an electronic device including the same.

Additional aspects will be set forth in part in the description which follows and, in part, will be apparent from the description, or may be learned by practice of the presented embodiments.

In accordance with an aspect of the disclosure, an electronic device is provided. The electronic device includes a first case member, a plurality of protruding members provided on the first case member or a supporting member disposed on the first case member, at least one speaker, an enclosure configured to receive at least a portion of the speaker and including a plurality of receiving recesses formed in a side surface of the enclosure, and engaging members engaged to the enclosure and at least partially positioned in the receiving recess, respectively. The engaging members may be engaged to one of the plurality of protruding members, respectively, to fix the enclosure to the first case member or the support member disposed on the first case member.

In accordance with another aspect of the disclosure, an electronic device is provided. The electronic device includes a first housing including a first case member and a second case member coupled to face the first case member, a plurality of protruding members formed on an inner surface of the first housing or a support member disposed in the first housing, at least one speaker, an enclosure configured to receive at least a portion of the speaker and including a plurality of receiving recesses formed in a side surface of the enclosure, and engaging members engaged to the enclosure and at least partially positioned in one of the receiving recess, respectively. As the engaging members are engaged to one of the plurality of protruding members, the enclosure may be received in the first housing while being spaced apart from an inner surface of the first case member, an inner surface of the second case member, or the support member disposed in the first housing.

In accordance with another aspect of the disclosure, a speaker module is provided. The speaker module includes at least one speaker, an enclosure including a first surface, a second surface facing away from the first surface, a side surface formed to at least partially surround a space between the first surface and the second surface, and a plurality of receiving recesses formed in the side surface, the enclosure receiving at least a portion of the speaker, and engaging members at least partially positioned in one of the receiving recesses, respectively, and engaged to the enclosure. The engaging members may be disposed to cross a direction perpendicular to the first surface or the second surface.

According to various embodiments disclosed in this document, the speaker module may be mounted on a case member of an electronic device or a support member disposed in the case member through an engaging member disposed on the side of the enclosure, thereby minimizing a reduction in the resonance space due to the mounting or engaging member. For example, the sound quality may be improved by providing a better ration of resonance space to occupied space in the electronic device. According to an embodiment of the disclosure, the engaging member is formed of a material including an elastic material to be able to absorb the mechanical vibration that is caused when sound is output, thereby blocking transfer of mechanical vibration to the structures surrounding the speaker module. For example, as noise due to mechanical vibration reduces, the user of the electronic device may enjoy, e.g., multimedia or game, on the electronic device in a better environment.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, it should be noted that like reference numbers are used to depict the same or similar elements, features, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
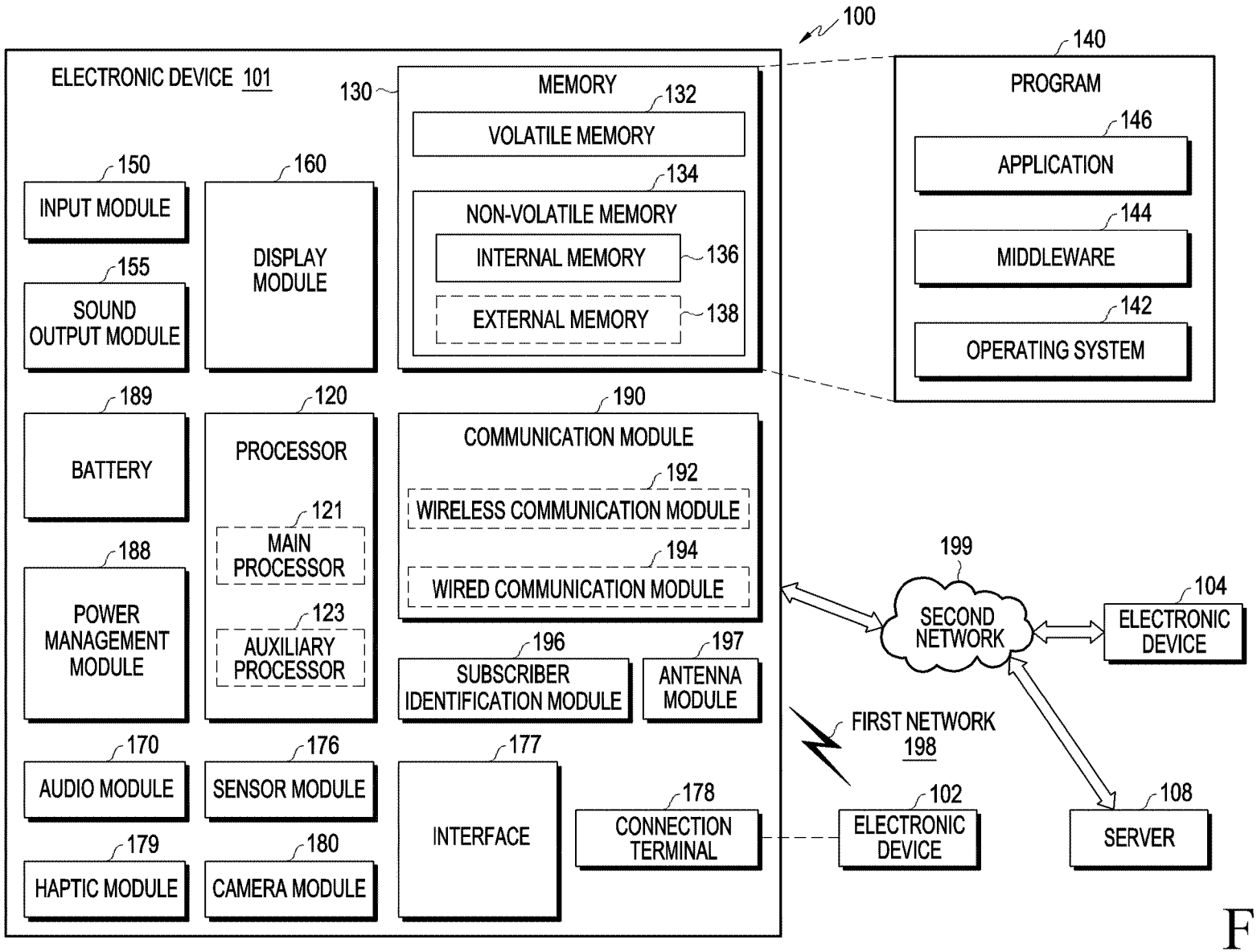
FIG. 1 is a view illustrating an electronic device in a network environment according to an embodiment of the disclosure.

FIG. 1 is a block diagram illustrating an electronic device in a network environment according to an embodiment of the disclosure.

Referring to FIG. 1, an electronic device 101 in a network environment 100 may communicate with an electronic device 102 via a first network 198 (e.g., a short-range wireless communication network), or an electronic device 104 or a server 108 via a second network 199 (e.g., a long-range wireless communication network). According to an embodiment of the disclosure, the electronic device 101 may communicate with the electronic device 104 via the server 108. According to an embodiment of the disclosure, the electronic device 101 may include a processor 120, memory 130, an input module 150, a sound output module 155, a display module 160, an audio module 170, a sensor module 176, an interface 177, a connecting terminal 178, a haptic module 179, a camera module 180, a power management module 188, a battery 189, a communication module 190, a subscriber identification module (SIM) 196, or an antenna module 197. In some embodiments of the disclosure, at least one (e.g., the connecting terminal 178) of the components may be omitted from the electronic device 101, or one or more other components may be added in the electronic device 101. According to an embodiment of the disclosure, some (e.g., the sensor module 176, the camera module 180, or the antenna module 197) of the components may be integrated into a single component (e.g., the display module 160).

The processor 120 may execute, for example, software (e.g., a program 140) to control at least one other component (e.g., a hardware or software component) of the electronic device 101 coupled with the processor 120, and may perform various data processing or computation. According to one embodiment of the disclosure, as at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. According to an embodiment of the disclosure, the processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 101 includes the main processor 121 and the auxiliary processor 123, the auxiliary processor 123 may be configured to use lower power than the main processor 121 or to be specified for a designated function. The auxiliary processor 123 may be implemented as separate from, or as part of the main processor 121.

The auxiliary processor 123 may control at least some of functions or states related to at least one component (e.g., the display module 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment of the disclosure, the auxiliary processor 123 (e.g., an image signal processor or a communication processor) may be implemented as part of another component (e.g., the camera module 180 or the communication module 190) functionally related to the auxiliary processor 123. According to an embodiment of the disclosure, the auxiliary processor 123 (e.g., the neural processing unit) may include a hardware structure specified for artificial intelligence model processing. The artificial intelligence model may be generated via machine learning. Such learning may be performed, e.g., by the electronic device 101 where the artificial intelligence is performed or via a separate server (e.g., the server 108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted Boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input module 150 may receive a command or data to be used by other component (e.g., the processor 120) of the electronic device 101, from the outside (e.g., a user) of the electronic device 101. The input module 150 may include, for example, a microphone, a mouse, a keyboard, keys (e.g., buttons), or a digital pen (e.g., a stylus pen).

The sound output module 155 may output sound signals to the outside of the electronic device 101. The sound output module 155 may include, for example, a speaker or a receiver. The speaker may be used for general purposes, such as playing multimedia or playing record. The receiver may be used for receiving incoming calls. According to an embodiment of the disclosure, the receiver may be implemented as separate from, or as part of the speaker.

The display module 160 may visually provide information to the outside (e.g., a user) of the electronic device 101. The display module 160 may include, for example, a display, a hologram device, or a projector and control circuitry to control a corresponding one of the display, hologram device, and projector. According to an embodiment of the disclosure, the display module 160 may include a touch sensor configured to detect a touch, or a pressure sensor configured to measure the intensity of a force generated by the touch.

The audio module 170 may convert a sound into an electrical signal and vice versa. According to an embodiment of the disclosure, the audio module 170 may obtain the sound via the input module 150, or output the sound via the sound output module 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment of the disclosure, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment of the disclosure, the interface 177 may include, for example, a high-definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment of the disclosure, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment of the disclosure, the haptic module 179 may include, for example, a motor, a piezoelectric element, or an electric stimulator.

The camera module 180 may capture an image or moving images. According to an embodiment of the disclosure, the camera module 180 may include one or more lenses, image sensors, image signal processors, or flashes.

The power management module 188 may manage power supplied to the electronic device 101. According to one embodiment of the disclosure, the power management module 188 may be implemented as at least part of, for example, a power management integrated circuit (PMIC).

The battery 189 may supply power to at least one component of the electronic device 101. According to an embodiment of the disclosure, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment of the disclosure, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via a first network 198 (e.g., a short-range communication network, such as Bluetooth™, wireless-fidelity (Wi-Fi) direct, or infrared data association (IrDA)) or a second network 199 (e.g., a long-range communication network, such as a legacy cellular network, a 5G network, a next-generation communication network, the Internet, or a computer network (e.g., local area network (LAN) or wide area network (WAN)). These various types of communication modules may be implemented as a single component (e.g., a single chip), or may be implemented as multi components (e.g., multi chips) separate from each other. The wireless communication module 192 may identify or authenticate the electronic device 101 in a communication network, such as the first network 198 or the second network 199, using subscriber information (e.g., international mobile subscriber identity (IMSI)) stored in the SIM 196.

The wireless communication module 192 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 192 may support a high-frequency band (e.g., the mmWave band) to achieve, e.g., a high data transmission rate. The wireless communication module 192 may support various technologies for securing performance on a high-frequency band, such as, e.g., beamforming, massive multiple-input and multiple-output (massive MIMO), full dimensional MIMO (FD-MIMO), array antenna, analog beam-forming, or large-scale antenna. The wireless communication module 192 may support various requirements specified in the electronic device 101, an external electronic device (e.g., the electronic device 104), or a network system (e.g., the second network 199). According to an embodiment of the disclosure, the wireless communication module 192 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 197 may transmit or receive a signal or power to or from the outside (e.g., the external electronic device). According to an embodiment of the disclosure, the antenna module may include an antenna including a radiator formed of a conductor or conductive pattern formed on a substrate (e.g., a printed circuit board (PCB)). According to an embodiment of the disclosure, the antenna module 197 may include a plurality of antennas (e.g., an antenna array). In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment of the disclosure, other parts (e.g., radio frequency integrated circuit (RFIC)) than the radiator may be further formed as part of the antenna module 197.

According to various embodiments of the disclosure, the antenna module 197 may form a mmWave antenna module. According to an embodiment of the disclosure, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment of the disclosure, commands or data may be transmitted or received between the electronic device 101 and the external electronic device 104 via the server 108 coupled with the second network 199. The external electronic devices 102 or 104 each may be a device of the same or a different type from the electronic device 101. According to an embodiment of the disclosure, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, mobile edge computing (MEC), or client-server computing technology may be used, for example. The electronic device 101 may provide ultra-low-latency services using, e.g., distributed computing or mobile edge computing. In another embodiment of the disclosure, the external electronic device 104 may include an internet-of-things (IoT) device. The server 108 may be an intelligent server using machine learning and/or a neural network. According to an embodiment of the disclosure, the external electronic device 104 or the server 108 may be included in the second network 199. The electronic device 101 may be applied to intelligent services (e.g., smart home, smart city, smart car, or healthcare) based on 5G communication technology or IoT-related technology.

The electronic device according to various embodiments may be one of various types of electronic devices. The electronic devices may include, for example, a portable communication device (e.g., a smart phone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment of the disclosure, the module may be implemented in a form of an application-specific integrated circuit (ASIC).

Various embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment of the disclosure, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments of the disclosure, each component (e.g., a module or a program) of the above-described components may include a single entity or multiple entities. Some of the plurality of entities may be separately disposed in different components. According to various embodiments of the disclosure, one or more of the above-described components may be omitted, or one or more other components may be added. Alternatively or additionally, a plurality of components (e.g., modules or programs) may be integrated into a single component. In such a case, according to various embodiments of the disclosure, the integrated component may perform one or more functions of each of the plurality of components in the same or similar manner as they are performed by a corresponding one of the plurality of components before the integration. According to various embodiments of the disclosure, operations performed by the module, the program, or another component may be carried out sequentially, in parallel, repeatedly, or heuristically, or one or more of the operations may be executed in a different order or omitted, or one or more other operations may be added.

Figure 2:
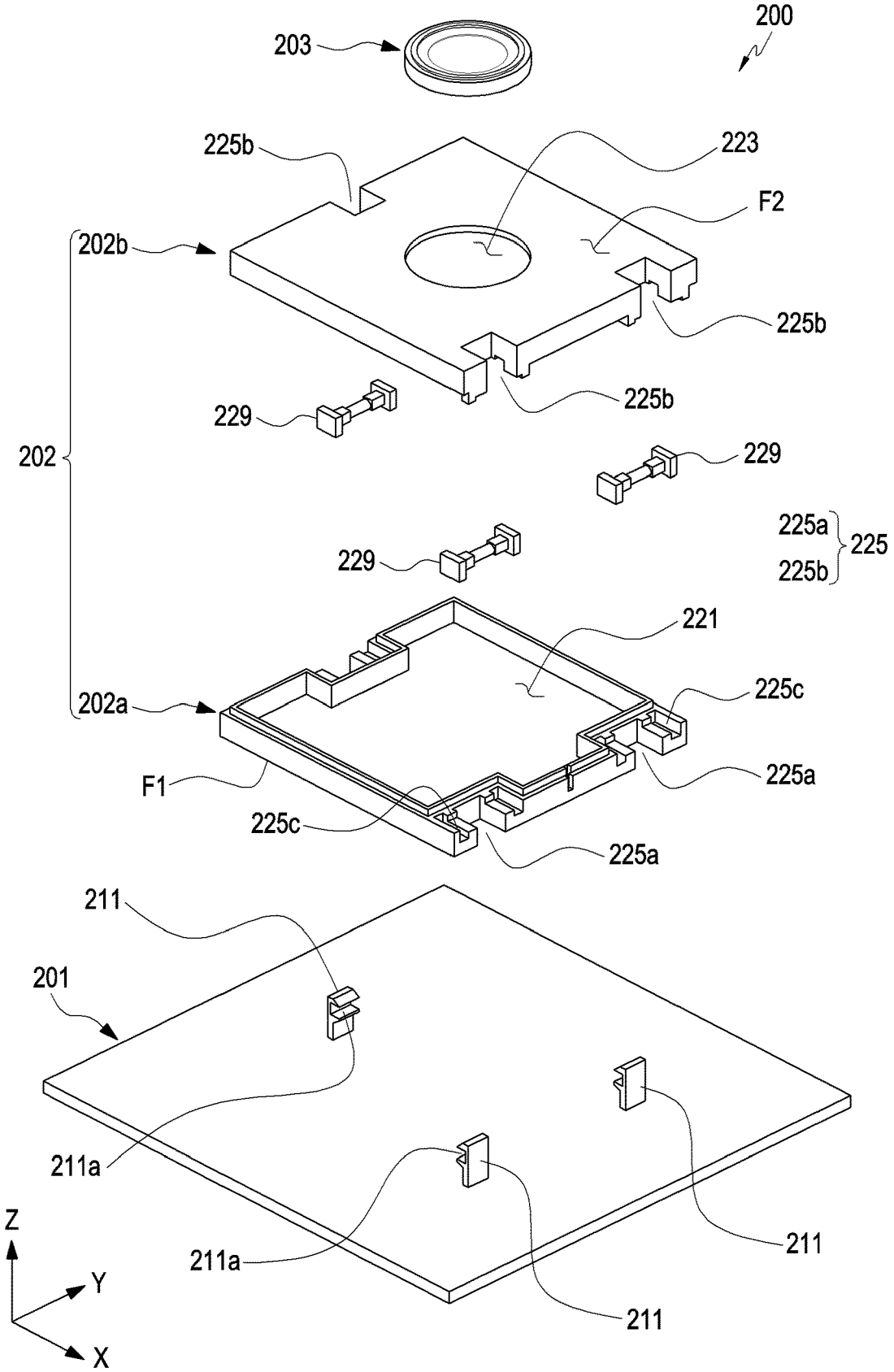
FIG. 2 is an exploded perspective view illustrating a speaker module according to an embodiment of the disclosure.
Figure 3:
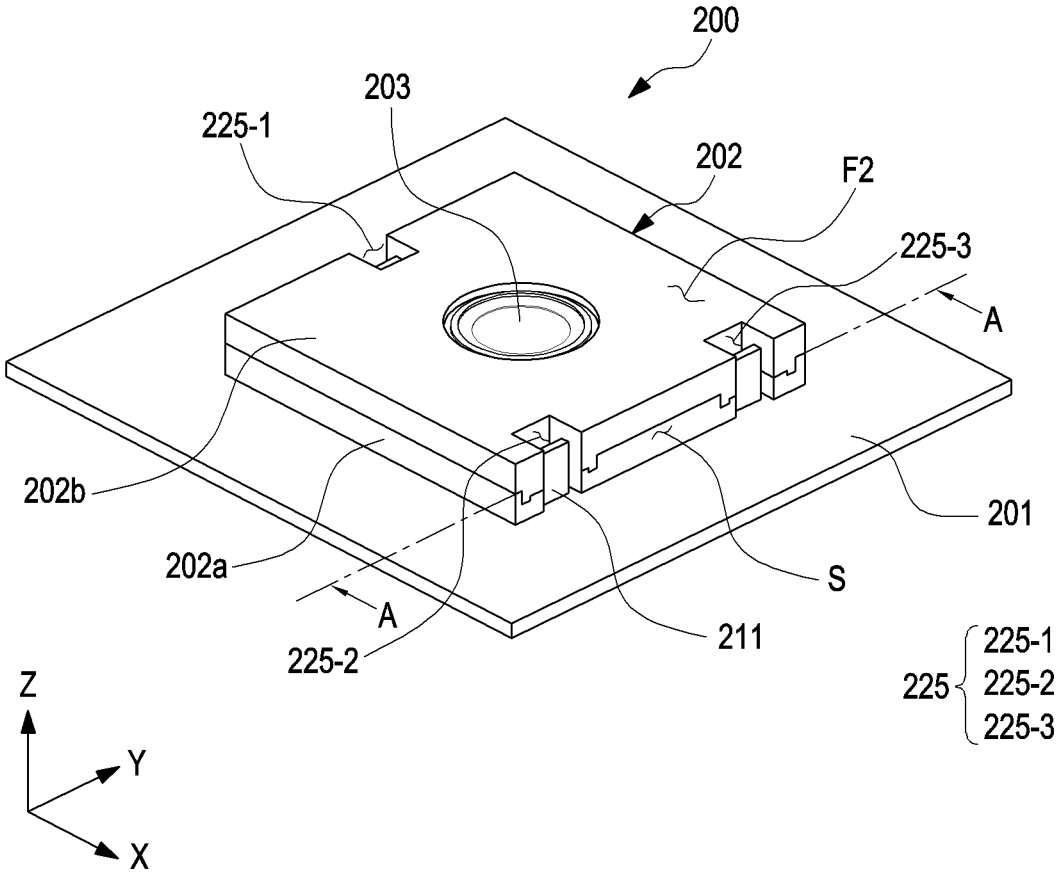
FIG. 3 is a perspective view illustrating an assembled speaker module according to an embodiment of the disclosure.
Figure 4:
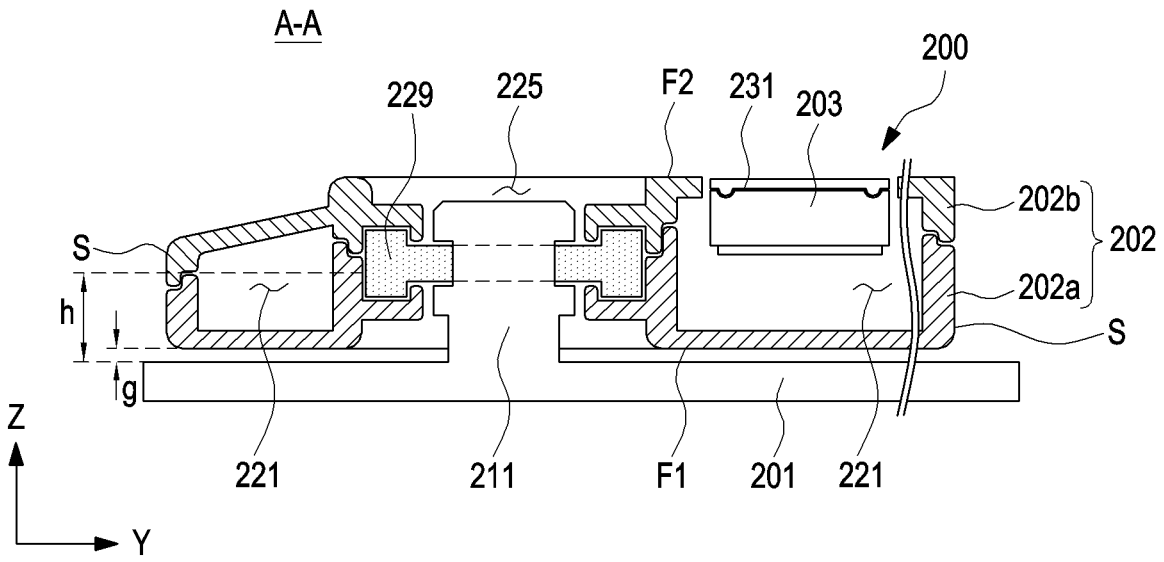
FIG. 4 is a cross-sectional view illustrating a speaker module according to an embodiment of the disclosure.

FIG. 2 is an exploded perspective view illustrating a speaker module 200 according to an embodiment of the disclosure. FIG. 3 is a perspective view illustrating an assembled speaker module 200 according to an embodiment of the disclosure. FIG. 4 is a cross-sectional view illustrating a speaker module 200 according to an embodiment of the disclosure.

FIG. 4 is a cross-sectional view of the speaker module 200, taken along line A-A of FIG. 3.

Referring to FIGS. 2 to 4, the speaker module 200 (e.g., the sound output module 155 of FIG. 1) may include an enclosure 202, a speaker unit(s) 203 and/or an engaging member(s) 229, and may be mounted on the case member 201 (e.g., a first case member 701*a* of FIG. 14) of the electronic device (e.g., the electronic device 101 or 700 of FIG. 1 or 13) through the protruding member 211. The enclosure 202 may mean a housing or casing surrounding the speaker unit(s) 203. In an embodiment of the disclosure, the enclosure 202 may be a sound box that produces a large sound volume by collecting at least some of the sounds generated by the speaker unit(s) 203.

As will be described below with reference to FIG. 12, according to embodiments of the disclosure, the electronic device may further include a support member (e.g., a support member 619*a* of FIG. 12). A protruding member 211 (e.g., a protruding member of FIG. 12) may be formed on at least a portion of the support member 619*a*. For example, the speaker module 200, e.g., the enclosure 202, may be disposed on the case member 201 (e.g., the case member 601 of FIG. 12) while being mounted on the support member 619*a*. In one embodiment of the disclosure, the case member 201 may form the whole or part of the housing (e.g., the first housing 701 of FIG. 13 or 14) of the electronic device. In another embodiment of the disclosure, the speaker module 200 may include a plurality of speaker units, e.g., a woofer or a tweeter as well as a normal speaker, disposed in the enclosure 202.

According to various embodiments of the disclosure, the case member 201 may be formed of a metal material (e.g., aluminum, stainless steel (STS) or magnesium), a polymer material, coated or colored glass, ceramic, or a combination of at least two of the above materials. In an embodiment of the disclosure, the case member 201 may form at least a portion of the housing of the electronic device. For example, the case member 201 may at least partially form a space for receiving a circuit board on which electronic components, such as the processor 120 or the communication module 190 of FIG. 1 are mounted and a battery (e.g., the battery 189 of FIG. 1). The protruding member(s) 211 may be formed of substantially the same material as the case member 201, e.g., a metal material or a polymer. In another embodiment of the disclosure, the protruding member(s) 211 may include a material different from the case member 201. For example, the case member 201 may include a polymer material, and the protruding member(s) 211 may include a metal material.

According to an embodiment of the disclosure, the protruding member 211 may vertically or inclinedly extend from the support member (e.g., the support member 619*a* of FIG. 12) disposed on the case member 201 or one surface (e.g., an inner surface) of the case member 201 and may include an engaging recess 211*a* formed in one side surface thereof. In another embodiment of the disclosure, the engaging recess 211*a* may be formed to cross the direction in which the protruding member 211 extends. For example, the protruding member 211 may protrude or extend in the +Z direction from the case member 201 or the support member (e.g., the support member 619*a* in FIG. 12), and the engaging recess 211*a* may be recessed from one side surface of the protruding member 211 in the +X direction or −X direction while extending in the +Y direction or −Y direction. In an embodiment of the disclosure, depending on the position or alignment direction of the protruding member 211, the engaging recess 211*a* may extend in the +X or −X direction while being recessed in the Y or −Y direction.

According to various embodiments of the disclosure, the enclosure 202 may include a first surface F1, a second surface F2 facing away from the first surface F1, and a side surface (e.g., the side surface S of FIG. 3) formed to at least partially surround the space between the first surface F1 and the second surface F2. The first surface F1 is, e.g., a surface disposed to face the case member 201 or the support member (e.g., the support member 619*a* in FIG. 12), and may be spaced apart from the case member 201 at a predetermined gap g (refer to FIG. 4). According to an embodiment of the disclosure, a shock absorbing member, such as a sponge may be disposed between the case member 201 or the support member (e.g., the support member 619*a* in FIG. 12) and the enclosure 202 to maintain the predetermined gap g while preventing the vibration generated in the enclosure 202 from being transmitted to the case member 201 or the support member (e.g., the support member 619*a* of FIG. 12). The predetermined gap g may be a value specified or predetermined by the developer or manufacturer during design or manufacturing process. The predetermined gap g may include a tolerance caused by the manufacturing process and materials. According to an embodiment of the disclosure, the second surface F2 may be a surface facing in a direction in which sound is output. For example, the speaker unit(s) 203 may be at least partially exposed to the second surface F2. According to an embodiment of the disclosure, the speaker module 200 or the enclosure 202 may include an opening area 223 formed in the second surface F2, and a portion of the speaker unit 203 may be exposed to the second surface F2 through the opening area 223. In another embodiment of the disclosure, depending on the number and arrangement of the speaker unit(s) 203, the direction in which the sound is output may be defined as the direction of the first surface F1 or the side surface S. In consideration of the direction in which sound is output, the enclosure 202 may include an additional opening area (e.g., the opening area 223) in an appropriate position. In another embodiment of the disclosure, a plurality of receiving recesses 225, 225-1, 225-2, and 225-3 may be formed in the side surface S, and the engaging member 229 may be coupled to the enclosure 202 while being at least partially received in the receiving recess 225. In FIG. 3, although the different receiving recesses are denoted with "225-*n*" in the drawings for distinguishing purposes, the term "receiving recess" is denoted simply with reference number "225" for brevity purposes and, as necessary, it may be interchangeably used with the reference denotation "225-*n*."

According to an embodiment of the disclosure, the enclosure 202 includes a first enclosure 202*a* providing the first surface F1 and a second enclosure 202*b* providing the second surface F2, and as the second enclosure 202*b* is coupled to face the first enclosure 202*a*, an internal space 221 may be formed. The speaker unit(s) 203 may be substantially received or disposed in the internal space 221 and may be at least partially exposed to the outside of the enclosure 202 through the opening area 223. According to an embodiment of the disclosure, the side surface S may be substantially completed as the first enclosure 202*a* and the second enclosure 202*b* are coupled together. In an embodiment of the disclosure, the internal space 221 may be defined as a "resonance space".

According to an embodiment of the disclosure, the enclosure 202 may include a first receiving portion(s) 225*a* formed in the first enclosure 202*a* and a second receiving portion(s) 225*b* formed in the second enclosure 202*b*. When the first enclosure 202*a* and the second enclosure 202*b* are coupled, the second receiving portion 225*b* may be connected to the first receiving portion 225*a*, forming the receiving recess 225. For example, the first receiving portion(s) 225*a* may be formed at the edge of the first enclosure 202*a*, the second receiving part(s) 225*b* may be formed at the edge of the second enclosure 202*b*, and when the first enclosure 202*a* and the second enclosure 202*b* are coupled, the side surface S and the receiving recess(es) 225 may be formed.

According to an embodiment of the disclosure, the enclosure 202 may include at least one pair of receiving recesses 225-2 and 225-3 formed in an area of the side surface S, which faces in the first direction (e.g., +X direction) and at least one receiving recess 225-1 formed in an area of the side surface S, which faces in the second direction (e.g., −X direction). For example, the plurality of receiving recesses 225 may be disposed to face in the opposite directions on the enclosure 202, and the receiving recesses 225 may be provided in various numbers. Although FIGS. 2 and 3 illustrate an example configuration in which one pair of receiving recesses (e.g., receiving recesses 225-2 and 225-3) are formed in the area facing in the +X direction, and one receiving recess (e.g., the receiving recess 225-1) is formed in the area facing in the −X direction, embodiments of the disclosure are not limited thereto. For example, a pair of receiving recesses 225 may be formed in the area facing in the +X direction and another pair of receiving recesses may be formed in the area facing in the −X direction. According to an embodiment of the disclosure, one receiving recess 225 may be formed in the area facing in the +X direction and another one receiving recess may be formed in the area facing in the −X direction. According to an embodiment of the disclosure, three or more receiving recesses 225 may be formed in the area facing in the +X direction and one receiving recess may be formed in the area facing in the −X direction. For example, depending on the shape or size of the speaker module 200 or the enclosure 202 actually manufactured, the position or number of the receiving recesses 225 may be varied.

According to an embodiment of the disclosure, the enclosure 202 may further include fixing grooves 225*c* individually provided in both sides of the receiving recess 225. For example, when the enclosure 202 includes three receiving recesses 225, the enclosure 202 may include six fixing grooves 225*c*. The fixing grooves 225*c* may be formed in at least one of the first enclosure 202*a* or the second enclosure 202*b*, and may be disposed symmetrically to each other with respect to the receiving recess 225. According to an embodiment of the disclosure, as the groove formed in the first enclosure 202*a* and the groove formed in the second enclosure 202*b* are connected together, the fixing grooves 225*c* may be formed. For example, similar to the side surface S and the receiving recess 225, the fixing grooves 225*c* may be formed as the first enclosure 202*a* and the second enclosure 202*b* are coupled to each other.

According to an embodiment of the disclosure, the engaging member(s) 229 may be at least partially received in the receiving recesses 225 with both ends thereof fastened to the fixing grooves 225*c*. The shape or structure of the engaging member(s) 229 will be described below with reference to FIGS. 5 and 6.

Figure 5:
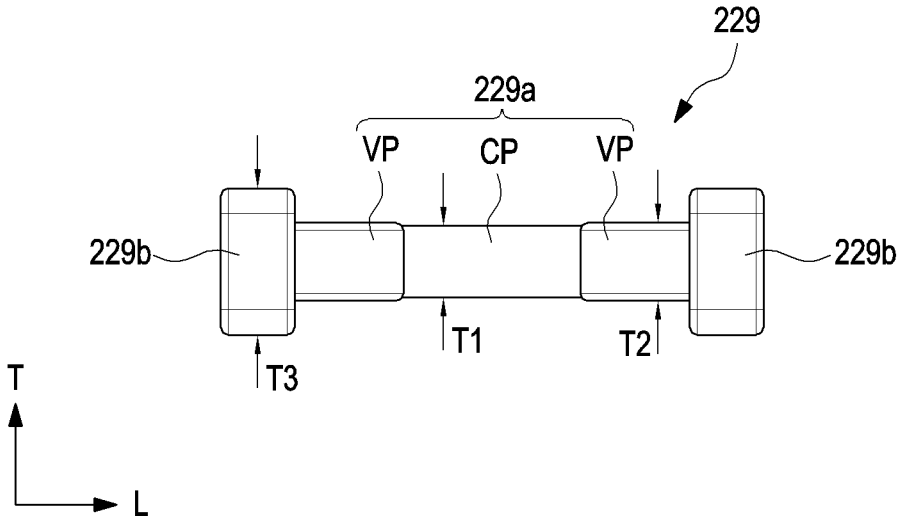
FIG. 5 is a side view illustrating an engaging member of a speaker module according to an embodiment of the disclosure.
Figure 6:
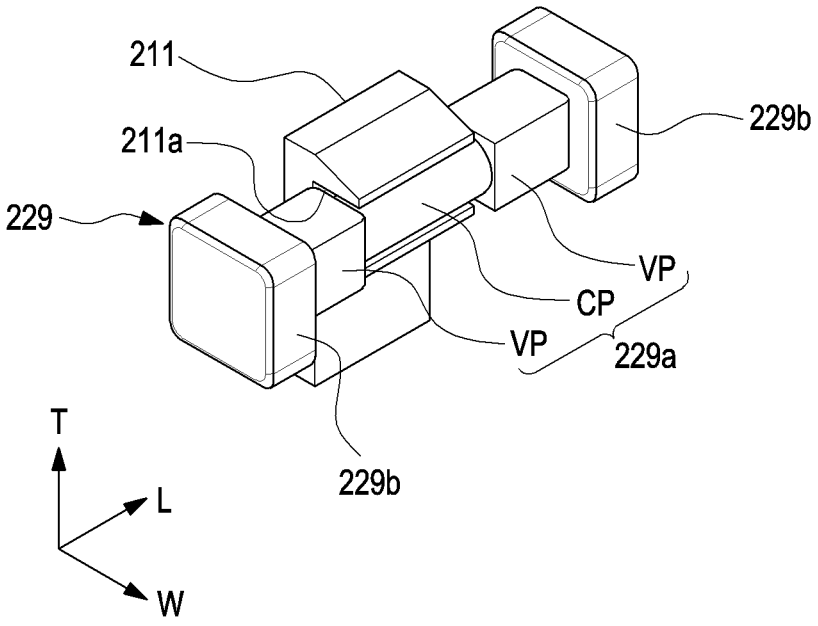
FIG. 6 is a perspective view illustrating an engaging member of a speaker module being coupled to a protruding member according to an embodiment of the disclosure.

FIG. 5 is a side view illustrating an engaging member of a speaker module according to an embodiment of the disclosure. FIG. 6 is a perspective view illustrating an engaging member of a speaker module being coupled to a protruding member according to an embodiment of the disclosure.

Referring to FIGS. 5 and 6, the engaging member 229 may include an extending portion 229*a* and an engaging portion(s) 229*b*, and a portion thereof, e.g., the extending portion 229*a* may be at least partially received or engaged to the protruding member 211 (e.g., the engaging recess 211*a*). The engaging portion 229*b* is provided at each of both ends of the extending portion 229*a* and may be engaged by the enclosure (e.g., the enclosure 202 of FIG. 2). For example, the engaging portion 229*b* may be engaged to the fixing groove (e.g., the fixing groove 225*c* of FIG. 2) of the enclosure 202. According to an embodiment of the disclosure, the extending portion 229*a* may extend in one direction (e.g., the length direction L) and may be disposed parallel to the X direction or the Y direction of FIG. 2 or 3. For example, at least a portion of the engaging member 229 or the extending portion 229*a* may be disposed to cross the protruding member 211. The engaging member 229 may be formed of, e.g., an elastic material, such as silicone, rubber, or urethane. For example, when mechanical vibration is applied, the engaging member 229 may absorb the mechanical vibration, thereby reducing the transfer of the mechanical vibration to other structures (e.g., the protruding member 211 or the case member 201 of FIG. 2). For example, the engaging portion 229*b* may be at least partially coupled to a flange (e.g., a structure forming the fixing groove 225*c* of FIG. 2) formed in the enclosure (e.g., the enclosure 202 of FIG. 2). The flange may be an edge shaped to protrude over the circumference of a member (e.g., the enclosure 202 of FIG. 2). The flange may be a portion protruding from the member and formed to couple with another member. According to an embodiment of the disclosure, the engaging member 229 may be dumbbell-shaped. According to an embodiment of the disclosure, the engaging member 229 may be formed of an elastic material (e.g., silicone, rubber, or urethane) having a hardness of about 45 high definition audio (HDA) to about 55 HDA based on type A of the rubber hardness tester as measured through the Shore test.

According to an embodiment of the disclosure, the extending portion 229*a* may include a protruding member 211, e.g., a central portion CP engaged with the engaging recess 211*a*, and a vibration absorbing portion (s) VP extending from both ends of the central portion CP. For example, the engaging portion 229*b* may be connected to the central portion CP of the extending portion 229*a* through the vibration absorbing portion VP. According to an embodiment of the disclosure, the engaging portion 229*b* and the protruding member 211 may be disposed apart from each other at a predetermined gap. For example, the vibration absorbing portion VP, along with the central portion CP, may function as a structure connecting the enclosure 202 with the protruding member 211 while maintaining the gap between the engaging portion 229*b* and the protruding member 211. Referring back to FIG. 4, the engaging member 229 may be engaged to the protruding member 211 at a predetermined height h from the case member 201, and a predetermined gap g may be formed between the first surface F1 of the enclosure 202 and the case member 201 or the support member (e.g., the support member 619*a* of FIG. 12). For example, the speaker module 200 or the enclosure 202 may be mounted on the case member 201 through the engaging member 229 or the protruding member 211 while being spaced apart from the case member 201. As will be described below, the vibration absorbing portion VP substantially absorbs mechanical vibration generated when the speaker module 200 outputs sound, preventing the mechanical vibration by the speaker module 200 from being transmitted to the protruding member 211 or the case member 201. For example, the predetermined gap g between the first side F1 of the enclosure 202 and the case member 201 or the support member (e.g., support member 619*a* of FIG. 12) may be about 0.2 to about 3.0 mm.

According to an embodiment of the disclosure, the extending portion 229*a*, e.g., the central portion CP, may have a circular or polygonal cross section when cut in a direction perpendicular to the length direction L. According to an embodiment of the disclosure, when the central portion CP has a circular shape, it may easily enter the engaging recess 211*a*. For example, when entering the engaging recess 211*a*, the surface of the central portion CP may be formed as a curved surface, making it easy to couple the engaging member 229 and the protruding member 211. According to an embodiment of the disclosure, another portion of the extending portion 229*a*, e.g., the vibration absorbing portion VP, may have a circular or polygonal cross section when cut in a direction perpendicular to the length direction L. In another embodiment of the disclosure, as the vibration absorbing portion VP has a cross section which is larger in area and different in shape than the central portion CP, it is possible to stably maintain the state in which the engaging member 229 is coupled or fixed to the protruding member 211.

According to an embodiment of the disclosure, the cross-sectional area of the central portion CP or the thickness (e.g., a first thickness T1) measured in a direction (e.g., the thickness direction T) perpendicular to the length direction L may be smaller than the cross-sectional area or thickness (e.g., a second thickness T2) of the vibration absorbing portion VP. For example, the protruding member 211 and/or the engaging recess 211*a* may be coupled to the central portion CP in the engaging member 229 and, while being coupled with the protruding member 211, the engaging member 229 may be restricted from movement in the length direction L (e.g., +L direction or −L direction) with respect to the protruding member 211. According to an embodiment of the disclosure, as the engaging member 229 may be restricted from moving in the length direction L with respect to the protruding member 211, the protruding member 211 may be disposed in the receiving recess 225 while staying apart from the inner wall of the receiving recess 225. In another embodiment of the disclosure, the cross-sectional areas or thicknesses (e.g., the first thickness T1 and the second thickness T2) of the central portion CP and the vibration absorbing portion VP may be substantially the same. In a structure in which the cross-sectional areas or thicknesses (e.g., the first thickness T1 and the second thickness T2) of the central portion CP and the vibration absorbing portion VP may be the same, the speaker module 200 may include interfering protrusions (not shown) on the surface of the extending portion 229*a*. For example, in the structure in which the cross-sectional areas or thicknesses (e.g., the first thickness (T1) and the second thickness (T2)) of the central portion CP and the vibration absorbing portion VP may be the same, the interfering protrusions are disposed to contact the protruding member 211, so that the engaging member 229 may be restricted from moving in the length direction L with respect to the protruding member 211.

According to an embodiment of the disclosure, the enclosure 202 may be avoided from direct contact with the protruding member 211 using the difference in cross-sectional area or thickness (e.g., the first thickness T1 and the second thickness T2) between the central portion CP and the vibration absorbing portion VP or the interfering protrusion (not shown). For example, the engaging member 229 may substantially absorb mechanical vibrations between the enclosure 202 and the protruding member 211. The length of the protruding member 211 extending from the case member 201, the shape or size of the engaging member 229, and the cross-sectional area or thickness of each portion (e.g., the central portion CP and the vibration absorbing portion VP) may be designed to maintain the gap between 202 and the case member 201 and/or between the inner wall of the receiving recess 225 and the protruding member 211. According to an embodiment of the disclosure, given the ability to absorb mechanical vibrations according to the operation of the speaker module 200, the hardness or elastic modulus of the engaging member 229, and relative cross-sectional areas or thicknesses (e.g., the first thickness T1 and the second thickness T2) of the central portion CP and the vibration absorbing portion VP may be designed. For example, the hardness (Japanese industrial standard (JIS)) of the engaging member 229 may be about 10 to about 60. Alternatively, the cross-sectional area or the first thickness T1 of the central portion CP may be the same as, or ¼ or more of, the cross-sectional area or the second thickness T2 of the vibration absorbing portion VP.

According to an embodiment of the disclosure, the engaging portion 229*b* may have a circular or polygonal cross section when cut in a direction perpendicular to the length direction L. The engaging portion 229*b* may be designed in various cross-sectional shapes, considering the assembly structure with the fixing groove 225*c* or the engaging force according to the cross-sectional shape. According to an embodiment of the disclosure, the cross-sectional area, or the thickness (e.g., a third thickness T3) measured in the thickness direction T, of the engaging portion 229*b* may be larger than the thickness (e.g., the first thickness T1 or the second thickness T2) of the central portion CP or the vibration absorbing portion VP of the extending portion 229*a*. For example, given the engaging force between the engaging member 229 and the enclosure 202, the cross-sectional area or the third thickness T3 of the engaging portion 229*b* may be designed to be larger than the extending portion 229*a*. In the illustrated configuration, the central portion CP has a circular cross section, and the vibration absorbing portion VP or engaging portion 229*b* has a rectangular cross section. However, embodiments of the disclosure are not limited thereto, and the cross-sectional shape of the engaging member 229 may be varied considering factors, such as assembly structure, vibration absorption performance, or engaging force. For example, the vibration absorbing portion VP or the engaging portion 229*b* may have a circular cross section. According to an embodiment of the disclosure, the engaging member 229 may be formed of a plurality of materials. For example, the central portion CP may be formed of an elastic material, such as silicone or rubber, and the vibration absorbing portion VP or the engaging portion 229*b* may be formed of a metal member or an injection-molded member.

Referring back to FIGS. 2 to 4, as the first enclosure 202*a* may be coupled with the second enclosure 202*b* with the engaging portion 229*b* is positioned on the fixing groove 225*c*, the engaging member 229 may be disposed within the receiving recess 225. For example, with the extending portion 229*a* at least partially positioned in the receiving recess 225, the engaging portion 229*b* may be fixed to the fixing groove 225*c*. In the state where the engaging portion 229*b* is fixed to the fixing groove 225*c*, the engaging member 229, e.g., the extending portion 229*a*, may be disposed to cross the direction perpendicular to the first surface F1 or second surface F2. According to an embodiment of the disclosure, the engaging member 229, e.g., the extending portion 229*a*, may be disposed substantially parallel to the first surface F1 or the second surface F2. When the engaging member 229, e.g., the central portion CP is engaged to the protruding member 211 (e.g., the engaging recess 211*a*), the enclosure 202 may be mounted on the case member 201 while maintaining a predetermined gap g from the case member 201. In the state in which the enclosure 202 is mounted on the case member 201, the protruding member 211 may be obliquely or vertically disposed with respect to the first surface F1 or the second surface F2, and a portion thereof may be positioned in the receiving recess 225. In the receiving recess 225, the protruding member 211 may stay apart from the inner wall of the receiving recess 225. For example, when the speaker module 200 outputs sound, the mechanical vibration generated in the speaker module 200 or the enclosure 202 is not directly transmitted to the protruding member 211 or the case member 201 but may be absorbed by the engaging member 229 which is formed of an elastic material. The speaker module 200, e.g., the speaker unit 203, may output sound towards the second surface F2 of the enclosure 202.

According to an embodiment of the disclosure, when outputting sound, the speaker unit 203, e.g., a diaphragm 231, may reciprocate along the Z direction, and due to this reciprocation or variations in sound pressure caused by the sound output, mechanical vibrations may occur. According to an embodiment of the disclosure, the vibration force generated when the speaker unit 203 outputs low-pitched sound may become stronger. Such mechanical vibration may cause friction or collision between the case member 201 and other structures (e.g., the input module 150 of FIG. 1 or a keypad 711 of FIG. 13), thereby creating noise. According to embodiments of the disclosure, in the speaker module 200 or an electronic device (e.g., the electronic device 101 or 700 of FIG. 1 or 13) including the speaker module 200, the engaging member 229 may be disposed in mounting the speaker module 200 (e.g., the enclosure 202) on the protruding member 211 or the case member 201, thereby reducing transmission of the mechanical vibration generated by the sound output to other structures around the speaker module 200.

According to an embodiment of the disclosure, the distance between the speaker unit 203 and the engaging members 229 may be the same. For example, when sound is output, the vibration force applied to each engaging member 229 (or the protruding member 211) may be the same. According to an embodiment of the disclosure, as the same vibration force is transmitted to the structure for fixing the speaker module 200 (or the enclosure 202), the engaging members 229 may uniformly absorb the vibration force or attenuate with respect to each other. According to an embodiment of the disclosure, in the structure that the same vibration force is transmitted to the fixing structure or the mounting structure (e.g., the protruding member 211 and/or the engaging member 229), the speaker unit 203 may be placed at the center of gravity of a polygon connecting the points where the engaging members 229 are disposed. For example, if the engaging members 229 are installed at the vertexes of a square, the speaker unit 203 may be located at the center of gravity of the square.

In the following description, the components easy to understand from the description of the above embodiments are denoted with or without the same reference numerals and their detailed description may be skipped.

Figure 7:
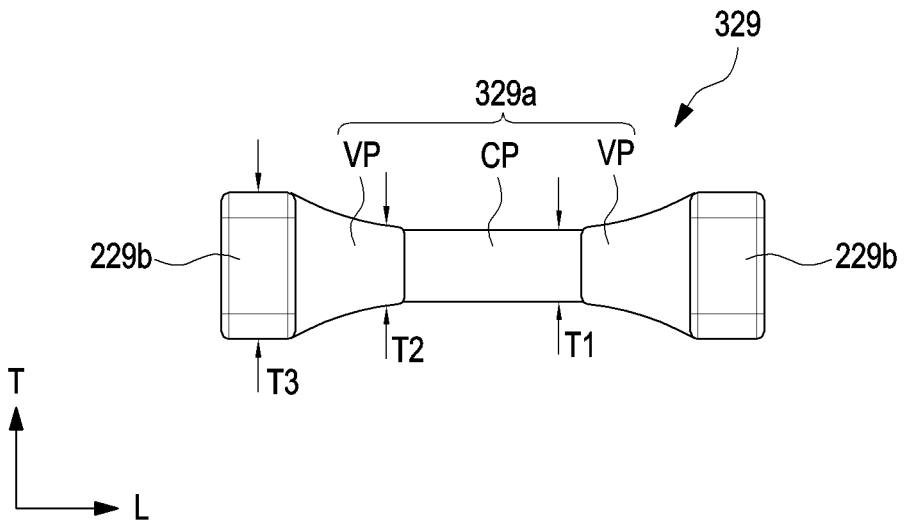
FIG. 7 is a side view illustrating an engaging member of a speaker module according to an embodiment of the disclosure.
Figure 8:
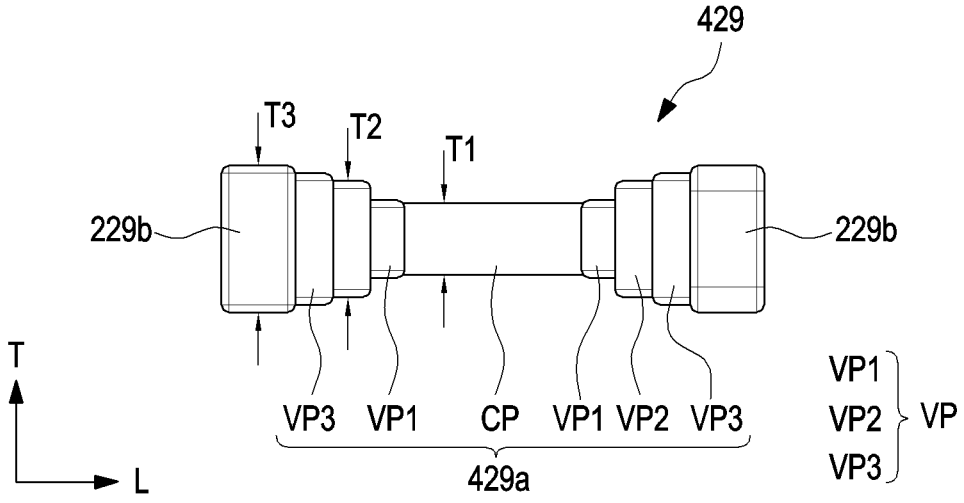
FIG. 8 is a side view illustrating an engaging member of a speaker module according to an embodiment of the disclosure.

FIG. 7 is a side view illustrating an engaging member of a speaker module according to an embodiment of the disclosure. FIG. 8 is a side view illustrating an engaging member of a speaker module according to an embodiment of the disclosure.

Referring to FIGS. 7 and 8, the extending portions 329*a* and 429*a* may have a shape in which its cross-sectional area gradually increases as the extending portions 329*a* and 429*a* approach the engaging portion 229*b* from the center. First, referring to FIG. 7, the cross-sectional area or the second thickness T2 of the vibration absorbing portion VP may gradually increase from where it contacts the central portion CP to where it contacts the engaging portion 229*b*. For example, when viewed from the exterior of the engaging member 329, the vibration absorbing portion VP may be curved or flat, and a portion thereof, which contacts the central portion CP, has the minimum cross-sectional area, and another portion which contacts the engaging portion 229*b* may have the maximum cross-sectional area. Referring to FIG. 8, the cross-sectional area or the second thickness T2 of the vibration absorbing portion VP of the engaging member 429 may stepwise increase. For example, the vibration absorbing portion VP may be divided into a plurality of sections VP1, VP2, and VP3 according to its thicknesses, and the section contacting the central portion CP may have the minimum cross-sectional area while the section contacting the engaging portion 229*b* may have the maximum cross-sectional area.

Figure 9:
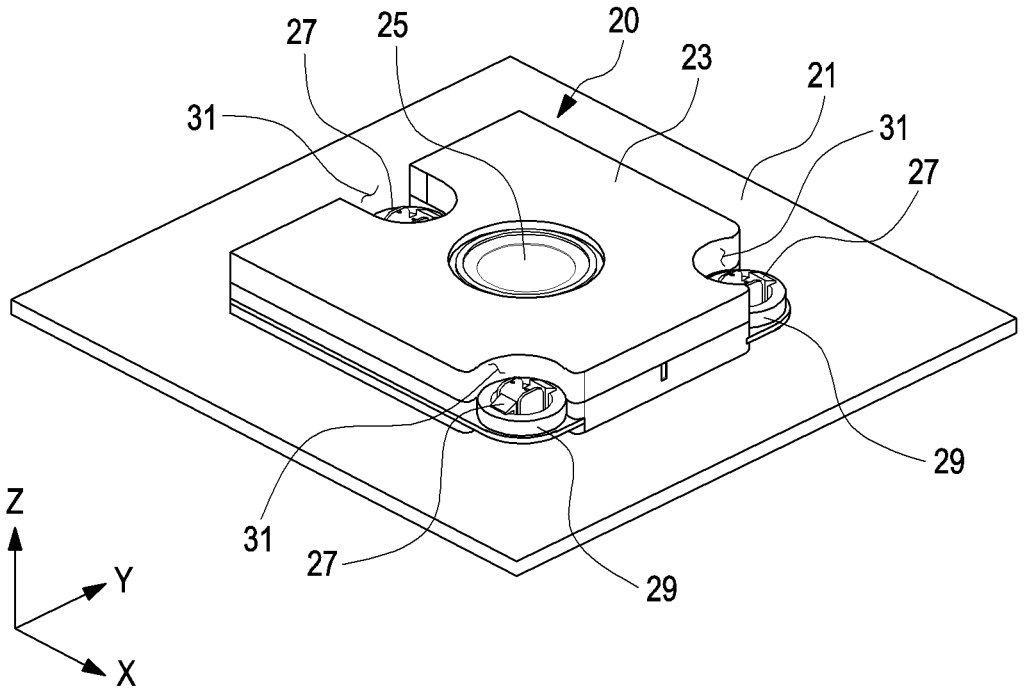
FIG. 9 is a perspective view illustrating a typical speaker module according to an embodiment of the disclosure.

FIG. 9 is a perspective view illustrating a typical speaker module according to an embodiment of the disclosure.

Referring to FIG. 9, a typical speaker module 20 may include an enclosure 23 receiving a speaker unit 25. As a protruding member 27 extending from the case member 21 is disposed through the enclosure 23 in the Z direction, the enclosure 23 may be mounted on the case member 21. A vibration absorbing member 29 which is coupled to surround the protruding member 27 may be disposed to suppress the vibration generated when sound is output or prevent transmission of such vibration to the surrounding structures. The enclosure 23 may provide a receiving space 31 in which the vibration absorbing member 29 may be disposed from the outside, thereby reducing the space used for installing the speaker module 20 and providing an environment in which it may be easy to install in a slim or compact electronic device. However, as the receiving space 31 formed outside the enclosure 23 enlarges, the internal space of the enclosure 23 may reduce, and the sound quality may degrade. For example, as the space (e.g., the internal space 221 of FIG. 2) in which the speaker unit 25 is received decreases, a limitation may be posed to delivery of a rich sound volume and sound tuning.

For example, under the condition where the space for installation is the same, e.g., in the conditions where the speaker module 200 of FIG. 3 and the speaker module 20 of FIG. 9 have the same maximum thickness (or height), maximum length, and/or maximum width, if the typical speaker module 20 has a volume of 5324 mm^3, the enclosure according to an embodiment may have a volume of 5731 mm^3. this may be attributed to the differences in the mounting structure of the vibration absorbing member 29 or the engaging member 229 disposed in the enclosures 23 and 202. As such, while occupying the same installation space, the enclosure 202 according to an embodiment of the disclosure may have an internal space (e.g., the internal space 221 of FIG. 2) which is about 407 mm^3 larger than the typical speaker module 20 or enclosure 23. Under the condition that the outputs of the speaker units 25 and 203 are the same, the increased internal space may contribute to increasing the sound volume of the speaker module 200. According to an embodiment of the disclosure, at least a portion of the expanded space may be utilized to change the shape of the internal space, which may facilitate tuning of sound characteristics. For example, if the speaker units 25 and 203 have the same output and occupy the same space in the electronic device, the enclosure 202 according to an embodiment may deliver a richer sound volume than the typical speaker module 20 and provide an easy way to tune the sound characteristics.

Figure 10:
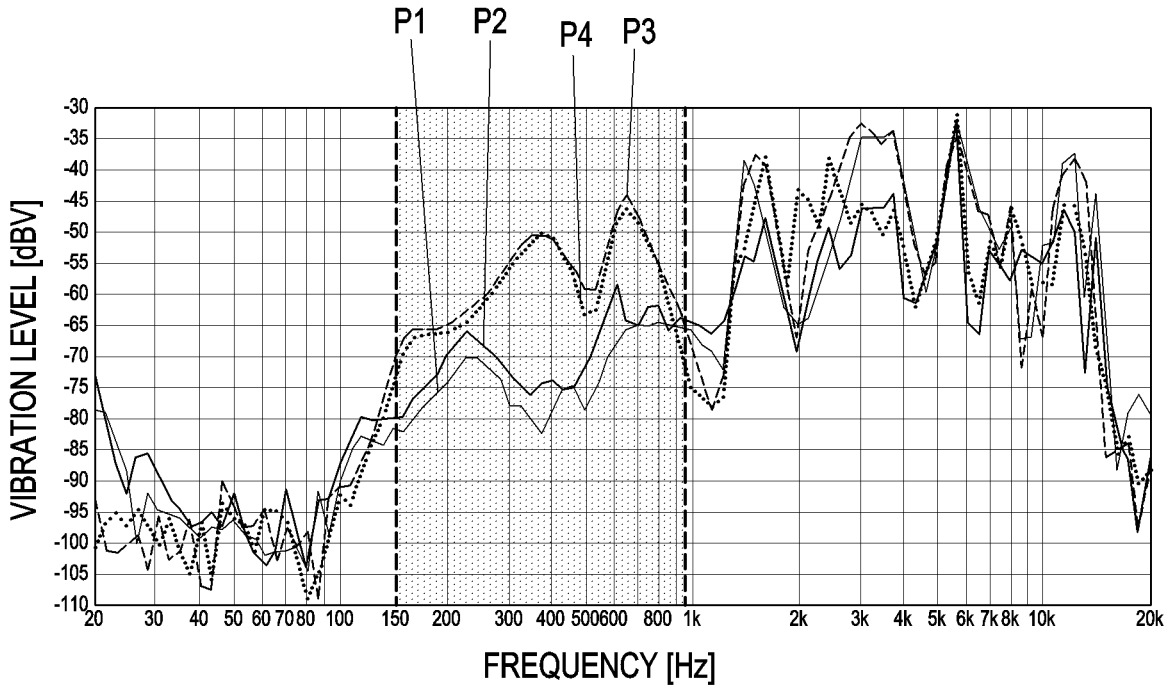
FIG. 10 is a graph illustrating measurements of mechanical vibrations generated when a speaker module of FIG. 3 and a speaker module of FIG. 9 are operated according to an embodiment of the disclosure.

FIG. 10 is a graph illustrating measurements of mechanical vibrations generated when a speaker module of FIG. 3 and a speaker module of FIG. 9 are operated according to an embodiment of the disclosure.

Referring to FIG. 10, the graphs indicated by "P1" and "P2" are the vibration levels measured for the speaker module 200 of FIG. 3, e.g., the enclosure 202 mounted on the case member 201 or the protruding member 211 through the engaging member 229, and "P3" and "P4" are the vibration levels measured for the speaker module 20 of FIG. 9, e.g., the enclosure 23 mounted on the case member 21, as a structure penetrated by the protruding member 27. Referring to FIG. 10, it may be identified that as compared with the speaker module 20 of FIG. 9, the speaker module 200 of FIG. 3 delivers a vibration force which has been improved by 30 dBV on average in the sound band ranging from about 150 Hz to 1000 Hz. For example, the speaker module 200 and/or the electronic device (e.g., the electronic device 101 or 700 of FIG. 1 or 13) according to various embodiments provides improved sound quality while preventing the vibration generated when sound is output from being transmitted to other structures (e.g., the protruding member 211 or the case member 201) around the speaker module 200 to thereby suppress noise.

Figure 11:
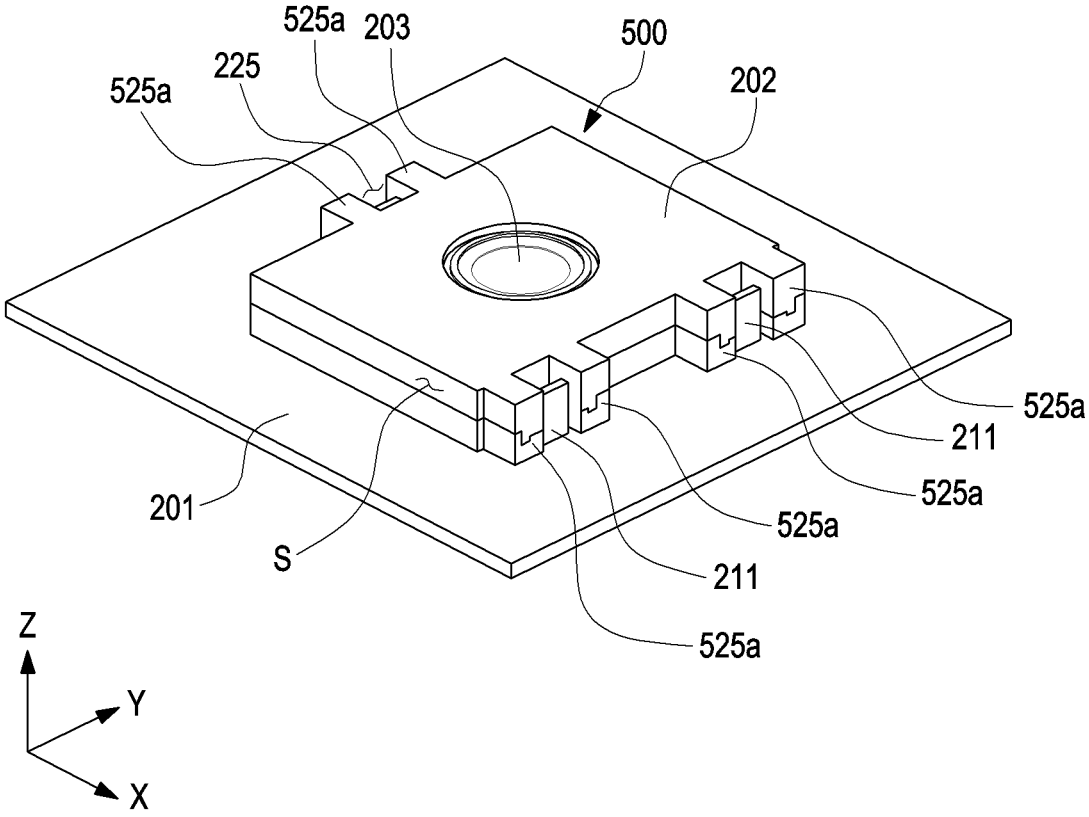
FIG. 11 is a perspective view a speaker module according to an embodiment of the disclosure.

FIG. 11 is a perspective view illustrating an speaker module according to an embodiment of the disclosure.

Referring to FIG. 11, the speaker module 500 and/or the enclosure 202 may include a plurality of fixing protrusions 525*a* protruding from the side surface S. The receiving recess 225 may be formed between a pair of fixing protrusions 525*a* adjacent to each other, and both ends of the engaging member (e.g., the engaging member 229 in FIG. 2) may be fixed inside the fixing protrusion 525*a*. For example, the fixing groove 225*c* of FIG. 2 may be formed inside the fixing protrusion 525*a* of FIG. 11. The structure in which the receiving recess 225 is formed between the fixing protrusions 525*a* may require a larger installation space than a typical speaker module (e.g., the speaker module 20 of FIG. 9). However, the speaker module 500 of FIG. 11 may provide an internal space (for example, the internal space 221 of FIG. 2) that has been more expanded than the speaker module 20 of FIG. 9 as well as the speaker module 200 of FIG. 3. For example, the speaker module 500 of FIG. 11 may deliver a richer sound volume, and when the same sound volume is provided, sound tuning may be easier. By expanding the internal space, it may be easy to arrange a plurality of speaker units (e.g., the speaker unit 203 of FIG. 2) inside the enclosure 202. For example, the speaker module 500 of FIG. 11 may make it easier to dispose a woofer for low-pitched sound or tweeter for high-pitched sound, as well as a normal speaker unit.

According to an embodiment of the disclosure, at least one pair of receiving recesses 225 may be formed in a partial area (e.g., an area facing in the +X direction) of the side surface S of the enclosure 202, and at least one receiving recess 225 may be formed in another partial area (e.g., an area facing in the −X direction) of the side surface S. According to an embodiment of the disclosure, an additional receiving recess may be provided in another area (e.g., an area facing in the +Y direction or the −Y direction) of the side surface S. In another embodiment of the disclosure, the enclosure 202 may include a plurality of receiving recesses 225, and the engaging member 229 may be disposed in a selected portion of the plurality of receiving recesses 225. For example, according to an embodiment of the disclosure, the speaker module 200 or the enclosure 202 may be easily installed in electronic devices with protruding members 211 different in number or shape by placing the engaging member 229 in the selected portion of the plurality of receiving recesses 225. According to an embodiment of the disclosure, the engaging member 229 may be disposed in a selected portion of the plurality of receiving recesses 225, and a fastening member, such as a screw may be disposed in at least one of the remaining receiving recess(s) 225. For example, a portion of the enclosure 202 may be mounted on the case member 201 or the support member (e.g., the support member 619*a* in FIG. 12) by the engaging member 229 and the protruding member 211, and another portion of the enclosure 202 may be mounted on the case member 201 or the support member (e.g., the support member 619*a* of FIG. 12) by the fastening member.

Figure 12:
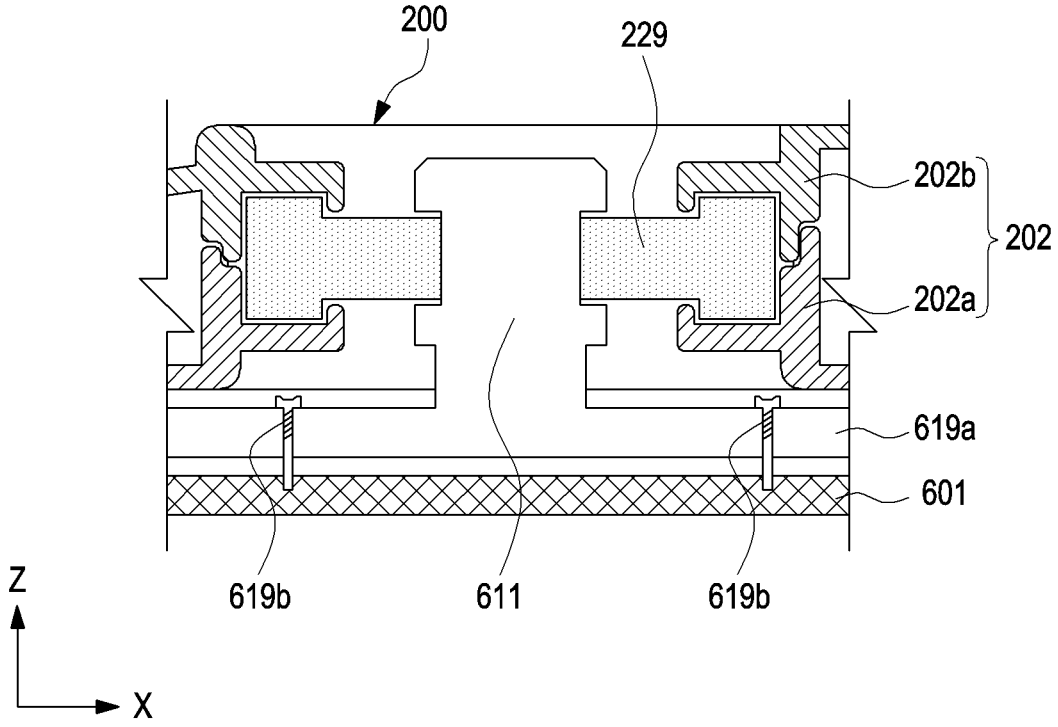
FIG. 12 is a cross-sectional view illustrating a mounting structure of a speaker module according to an embodiment of the disclosure.

FIG. 12 is a cross-sectional view illustrating a mounting structure of a speaker module according to an embodiment of the disclosure.

Referring to FIG. 12, according to an embodiment of the disclosure, the speaker module 200 may further include a support member 619*a* at least partially received in the case member 601 (e.g., the case member 201 of FIGS. 2 to 4). The support member 619*a* may block electromagnetic interference between electronic components disposed inside the case member 601 and increase the rigidity of the electronic device (e.g., the first housing 701 in FIG. 13). The support member 619*a* may be mounted or fixed to the case member 601 by a fastening member 619*b* (e.g., a screw). The support member 619*a* may be formed of a metal material or polymer according to an embodiment.

According to an embodiment of the disclosure, the protruding member 611 (e.g., the protruding member 211 of FIGS. 2 to 4) may substantially extend from the support member 619*a* to be coupled to the engaging member 229. For example, the speaker module 200 and/or the enclosure 202 may be substantially mounted on the support member 619*a* and, as the support member 619*a* is mounted on the case member 601, the speaker module 200 and/or the enclosure 202 may be disposed on the case member 601. The mechanical vibration generated when the speaker module 200 outputs sound may be at least partially absorbed by the engaging member 229, and the amount thereof, which is substantially transmitted to the protruding member 611, the support member 619*a*, and/or the case member 601, may be reduced.

Figure 13:
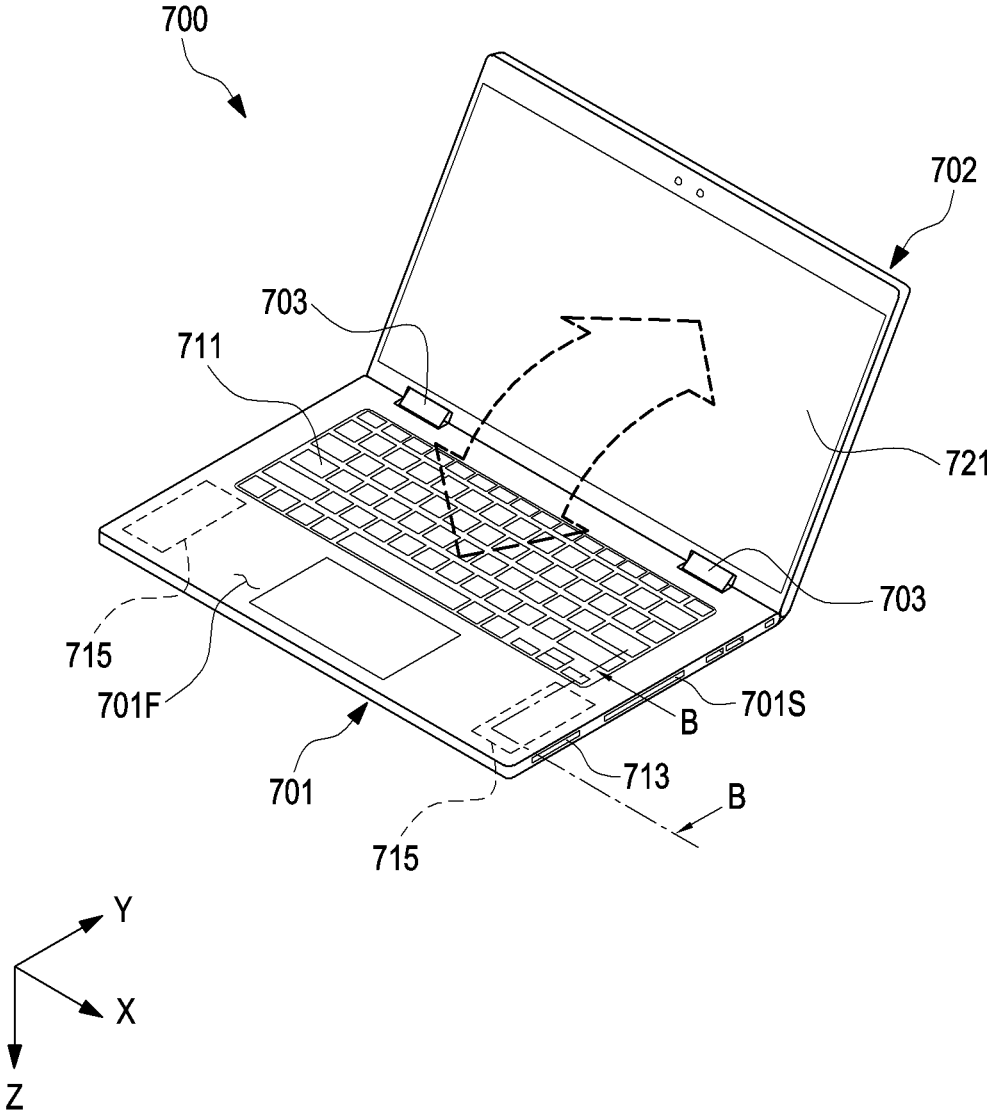
FIG. 13 is a perspective view illustrating an electronic device including a speaker module according to an embodiment of the disclosure.
Figure 14:
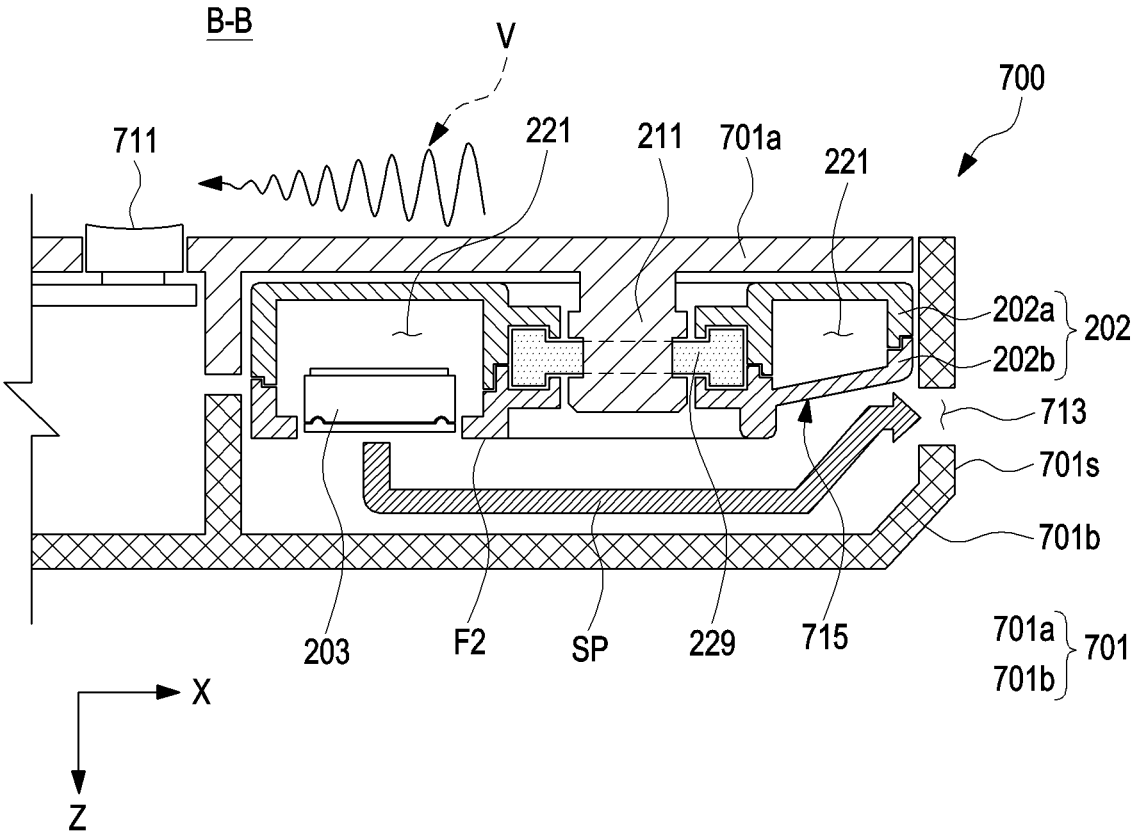
FIG. 14 is a cross-sectional view illustrating a configuration in which a speaker module is disposed in an electronic device of FIG. 13 according to an embodiment of the disclosure.

FIG. 13 is a perspective view illustrating an electronic device including a speaker module according to an embodiment of the disclosure. FIG. 14 is a cross-sectional view illustrating a configuration in which a speaker module is disposed in an electronic device of FIG. 13 according to an embodiment of the disclosure.

FIG. 14 is a cross-sectional view of an electronic device, taken along line B-B of FIG. 13.

Referring to FIGS. 13 and 14, an electronic device 700 may include a first housing 701, a second housing 702, a display 721, and/or the keypad 711. According to an embodiment of the disclosure, the second housing 702 may be rotatably coupled to the first housing 701 through a hinge device 703, so that it may rotate between a folded position in which it faces the front surface 701F of the first housing 701 and a position inclined with respect to the first housing 701. According to an embodiment of the disclosure, the second housing 702 may rotate between the position folded to face the front surface 701F of the first housing 701 and the position opposite to the first surface 701F of the first housing 701.

According to an embodiment of the disclosure, the first housing 701 may include a first case member 701*a* (for example, the case member 201 of FIG. 2 or 3) forming the front surface 701F and a second case member 701*b* coupled to face the first case member 701*a*, and the speaker module 715 (e.g., the speaker module 200 of FIGS. 2 to 4) may be received in the space between the first case member 701*a* and the second case member 701*b*. The first case member 701*a* may provide an area in which the keypad 711, such as a keypad or a track pad, is installed, and may be combined with the second case member 701*b* to form a side wall 701S. The first housing 701 and/or the electronic device 700 may include at least one sound hole 713 formed through the sidewall 701S.

According to an embodiment of the disclosure, the speaker module 715 may be disposed in the internal space of the first housing 701. For example, the protruding member 211 may extend from the inner surface of the first case member 701*a* and, as the engaging member 229 may be coupled to the protruding member 211, the enclosure 202 may be received in the first housing 701 while being spaced apart from the inner surface of the first case member 701*a*. In this embodiment of the disclosure, a configuration in which the speaker module 715 may be mounted on the first case member 701*a* is described, but embodiments of the disclosure are not limited thereto. According to an embodiment of the disclosure, the speaker module 715 may be mounted on the second case member 701*b* or a support member (e.g., the support member 619*a* of FIG. 12) (not shown).

According to an embodiment of the disclosure, a plurality (e.g., a pair) of speaker modules 715 (or enclosure 202) may be positioned adjacent to both ends of the first housing 701 in the +X/−X directions, or the at least one sound hole 713. For example, the sound output from the speaker module 715 may be radiated to the outside of the first housing 701 through the at least one sound hole 713. In FIG. 13, the arrow indicated by reference number "SP" may mean a path through which the sound or sound pressure output from the speaker unit 203 or the speaker module 715 travels. Although FIG. 13 illustrates an example configuration in which the at least one sound hole 713 is formed in the +X direction (or −X direction), embodiments of the disclosure are not limited thereto. For example, the at least one sound hole 713 may be formed in the −Y direction to correspond to a speaker (e.g., a tweeter) for high-pitched sound or may be formed in the +Z direction to correspond to a speaker (e.g., a woofer) for low-pitched sound. For example, the direction in which the at least one sound hole 713 is formed or the direction in which sound is radiated to the outside through the at least one sound hole 713 may vary depending on the actual product, and embodiments of the disclosure are not limited thereto.

According to an embodiment of the disclosure, the second housing 702 may be rotatably coupled to the first housing 701 through at least one hinge device 703, and the display 721 may be disposed on the second housing 702. According to an embodiment of the disclosure, the second housing 702 may be folded on the first housing 701, with the display 721 facing the keypad 711. For example, the display 721 may be open or closed as the second housing 702 rotates.

In FIG. 14, the arrow indicated by reference denotation "V" denotes the strength and direction of mechanical vibration generated when the speaker unit 203 or the speaker module 715 outputs sound. When the protruding member 211 may be in contact with the enclosure 202 or when the engaging member 229 cannot absorb mechanical vibration, relative vibrations may be caused between the keypad 711 and the first housing 701 (e.g., the first case member 701*a*). Such relative vibrations may cause noise and may be perceived by the user when the user touches the electronic device 700. In the electronic device 700 according to various embodiments of the disclosure, when the engaging member 229 is formed of an elastic material and keeps the protruding member 211 spaced apart from the enclosure 202, the engaging member 229 may absorb the mechanical vibration that occurs when sound is output or disperse the mechanical vibration in the horizontal direction (e.g., −X/+X direction or −Y/+Y direction) or vertical direction (e.g., −Z/+Z direction). For example, the arranged structure of the enclosure 202 and the engaging member 229 may absorb the vibration force in the horizontal direction (e.g., −X/+X direction or −Y/+Y direction), and the arranged structure of the engaging member 229 and the protruding member 211 may absorb the vibration force in the vertical direction (e.g., −Z/+Z direction). Therefore, it is possible to reduce transmission of the mechanical vibration to the protruding member 211 or the first case member 701*a* and suppress noise generation.

Figure 15:
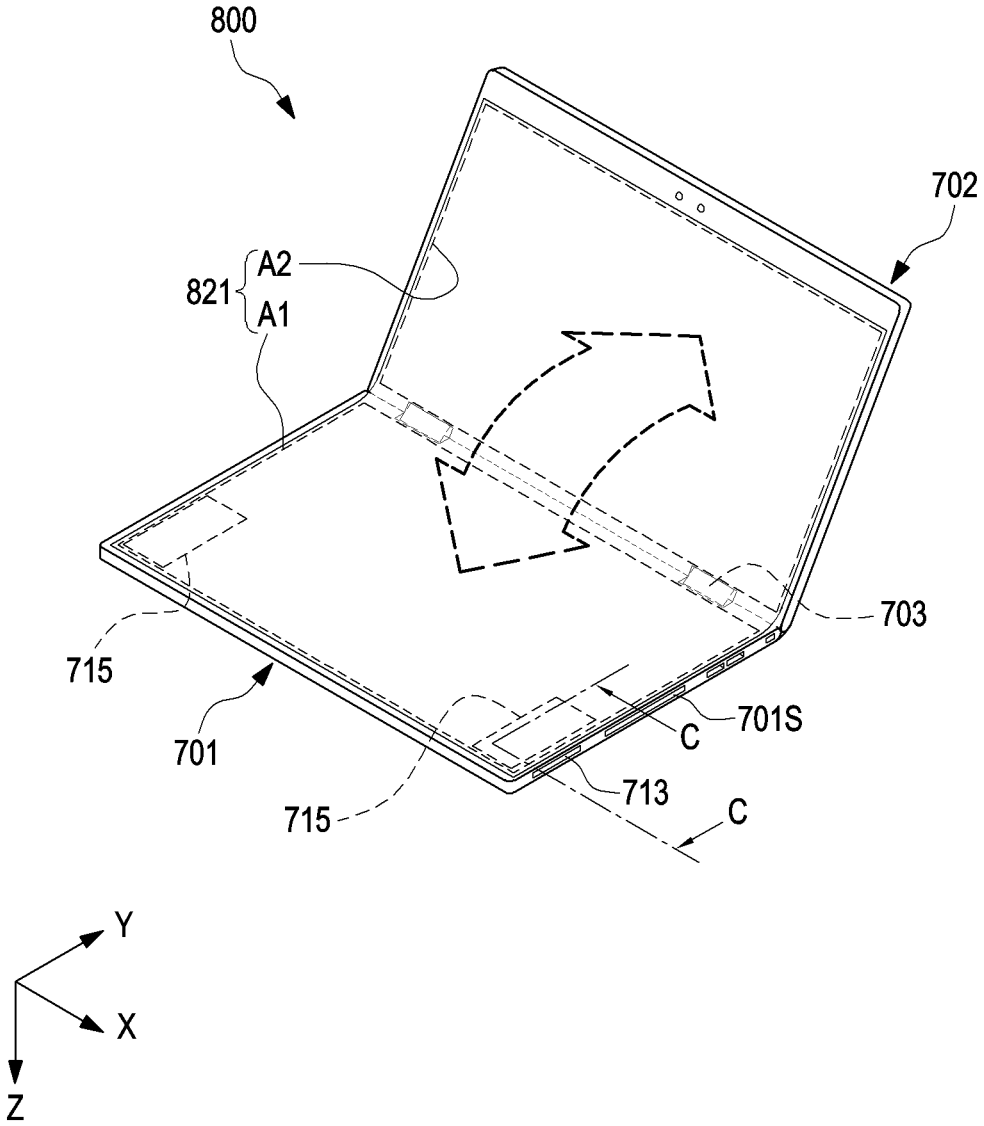
FIG. 15 is a perspective view illustrating an electronic device including a speaker module according to an embodiment of the disclosure.
Figure 16:
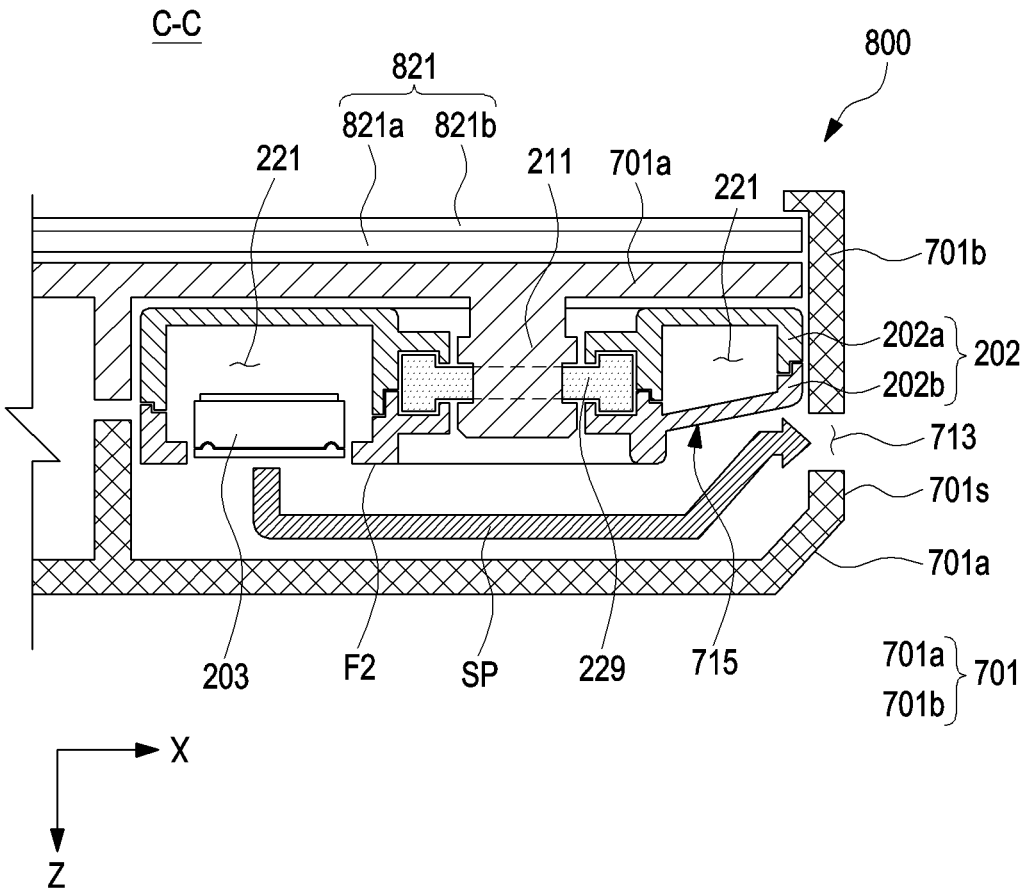
FIG. 16 is a cross-sectional view illustrating a configuration in which a speaker module is disposed in an electronic device of FIG. 15 according to an embodiment of the disclosure.

FIG. 15 is a perspective view illustrating an electronic device including a speaker module according to an embodiment of the disclosure. FIG. 16 is a cross-sectional view illustrating a configuration in which a speaker module is disposed in an electronic device of FIG. 15 according to an embodiment of the disclosure.

FIG. 16 is a cross-sectional view of an electronic device taken along line C-C of FIG. 15.

Referring to FIGS. 15 and 16, the electronic device 800 may include a first housing 701, a second housing 702, and a display 821, and at least a partial area of the display 821 may be utilized as an input module. According to an embodiment of the disclosure, the second housing 702 may be rotatably coupled to the first housing 701 through a hinge device (e.g., the hinge device 703 of FIG. 13), so that it may rotate between a folded position in which it faces the first housing 701 and a position inclined with respect to the first housing 701. According to an embodiment of the disclosure, the second housing 702 may rotate between the position folded to face the front surface of the first housing 701 and the position opposite to the first surface of the first housing 701.

According to an embodiment of the disclosure, the first housing 701 may include a first case member 701*a* (for example, the case member 201 of FIG. 2 or 3) forming the front surface and a second case member 701*b* coupled to face the first case member 701*a*, and the speaker module 715

(e.g., the speaker module 200 of FIGS. 2 to 4) may be received in the space between the first case member 701*a* and the second case member 701*b*. The first case member 701*a* may be coupled with the second case member 701*b*, forming a sidewall 701S. The first housing 701 and/or the electronic device 800 may include the at least one sound hole 713 formed through the sidewall 701S, and the speaker module 715 may be disposed in the internal space of the first housing 701 to radiate sound to the outside of the first housing 701 through the at least one sound hole 713. As described above, the at least one sound hole 713 may be formed to emit sound not only in the +X direction, but also in at least one direction selected from the −X direction, the −Y direction, or the +Z direction according to an embodiment.

According to an embodiment of the disclosure, the display 821 may include a display panel 821*a* and a protection layer 821*b*, and the protection layer 821*b* may be formed of glass or polymer and transmit light. For example, the protection layer 821*b* may transmit the screen output from the display panel 821*a* while protecting the display panel 821*a*. According to an embodiment of the disclosure, the electronic device 800 may utilize the display 821 as an input module by including a touch panel and/or a digitizer (not shown) integrated in the display 821. For example, at least a portion of the display 821 may replace the keypad 711 of FIG. 13. According to an embodiment of the disclosure, a partial area (e.g., the first area A1) of the display 821 may be disposed in the first housing 701, and another area (e.g., the second area A2) of the display 821 may extend from the first area A1 and may be substantially disposed in the second housing 702. For example, as the second housing 802 rotates, the second area A2 may be disposed to selectively face the first area A1. According to an embodiment of the disclosure, as the second area A2 faces the first area A1, the display 821 may be substantially closed and not exposed to the outside.

According to an embodiment of the disclosure, when the second housing 802 is unfolded to form an obtuse angle from the first housing 801, the first area A1 may be used as an input module (e.g., the keypad 711 of FIG. 13), such as a keypad or a track pad, and the second area A2 may be used as an output device that outputs a screen. In another embodiment of the disclosure, as the second housing 802 is unfolded to 180 degrees from the first housing 801, the first area A1 and the second area A2 in combination may be utilized as a screen output device while the electronic device (e.g., the processor 120 of FIG. 1) may simultaneously activate the touch panel or digitizer to set the display 821 as an input module.

As described above, according to an embodiment of the disclosure, an electronic device (e.g., the electronic device 101, 700, or 800 of FIG. 1, 13, or 15) comprises a case member (e.g., the case member 201 of FIG. 2 or the first case member 701*a* of FIG. 14), a plurality of protruding members (e.g., the protruding members 211 or 611 of FIG. 2 or 12) provided on the case member or a supporting member (e.g., the support member 619*a* of FIG. 12) disposed on the case member, at least one speaker unit (e.g., the speaker unit 203 of FIGS. 2 to 4), an enclosure (e.g., the enclosure 202 of FIG. 2 or 11) configured to receive at least a portion of the speaker unit and including a plurality of receiving recesses (e.g., the receiving recess 225 of FIG. 3 or 11) formed in a side surface, and engaging members (e.g., the engaging members 229, 329, and 429 of FIGS. 2 to 8) engaged to the enclosure and at least partially positioned in the receiving recess. The engaging members may be engaged to one of the protruding members to fix the enclosure to the case member or the support member disposed on the case member.

According to an embodiment of the disclosure, the engaging member may include at least one of silicone or rubber.

According to an embodiment of the disclosure, the engaging member may include an extending portion (e.g., the extending portion 229*a*, 329*a*, or 429*a* of FIG. 5, 7, or 8) engaged to the protruding member and engaging portions (e.g., the engaging portions 229*b* of FIG. 5, 7, or 8) provided at both ends of the extending portion and engaged to the enclosure. In a cross section cut in a direction perpendicular to a length direction of the extending portion, the extending portion may have a smaller cross-sectional area than the engaging portion.

According to an embodiment of the disclosure, the extending portion may have a circular or polygonal cross section, and the engaging portion may have a polygonal shape.

According to an embodiment of the disclosure, the extending portion may have a cross section increasing towards the engaging portion.

According to an embodiment of the disclosure, the enclosure may include a first surface (e.g., the first surface F1 of FIG. 2 or 4) disposed to face the case member and a second surface (e.g., the second surface F2 of FIGS. 2 to 4) disposed to face away from the first surface. The side surface may be formed to at least partially surround a space between the first surface and the second surface.

According to an embodiment of the disclosure, the protruding member may be disposed inclined or perpendicular to the first surface or the second surface and may be at least partially positioned in the receiving recess.

According to an embodiment of the disclosure, the protruding member may be disposed inclined or perpendicular to the first surface or the second surface and may include an engaging recess (e.g., the engaging recess 211*a* of FIG. 2 or 6) formed in a side surface thereof. The engaging member may be received or engaged to the engaging recess while being aligned in a direction crossing the protruding member.

According to an embodiment of the disclosure, the speaker unit may be at least partially exposed from the second surface.

According to an embodiment of the disclosure, the enclosure may include a first enclosure (e.g., the first enclosure 202*a* of FIGS. 2 to 4) providing the first surface and a second enclosure (e.g., the second enclosure 202*b* of FIGS. 2 to 4) providing the second surface. The second enclosure and the first enclosure may be coupled together to face each other to form the side surface.

According to an embodiment of the disclosure, the enclosure further may include a plurality of first receiving portions (e.g., the first receiving portion 225*a* of FIG. 2) formed in the first enclosure, a plurality of second receiving portions (e.g., the second receiving portion 225*b* of FIG. 2) formed in the second enclosure and, when the second enclosure may be coupled with the first enclosure, connected to the first receiving portion to form the receiving recess, and fixing grooves (e.g., the second fixing grooves 225*c* of FIG. 2) formed in at least one of the first enclosure or the second enclosure and individually fixed to both sides of the receiving recess. When the engaging member is disposed in the receiving recess, each of both ends of the engaging member may be engaged to one of the fixing grooves.

According to an embodiment of the disclosure, the protruding member may include a metal or polymer and extend from an inner surface of the case member.

According to an embodiment of the disclosure, the electronic device may further comprise a support member (e.g., the support member 619*a* of FIG. 12) received inside the case member. The protruding member may include a metal or polymer and extend from the support member.

According to an embodiment of the disclosure, an electronic device (e.g., the electronic device 101, 700, or 800 of FIG. 1, 13, or 15) comprises a first housing (e.g., the first housing 701 of FIG. 13 or 14) including a first case member (e.g., the case member 201 of FIG. 2 or the first case member 701*a* of FIG. 14) and a second case member (e.g., the second case member 701*b* of FIG. 14) coupled to face the first case member, a plurality of protruding members (e.g., the protruding member 211 of FIG. 2 or 14) formed on an inner surface of the first housing or a support member (e.g., the support member 619*a* of FIG. 12) disposed in the first housing, at least one speaker unit (e.g., the speaker unit 203 of FIG. 2 or 14), an enclosure (e.g., the enclosure 202 of FIG. 2 or 14) configured to receive at least a portion of the speaker unit and including a plurality of receiving recesses (e.g., the receiving recesses 225 of FIG. 3 or 4) formed in a side surface, and engaging members (e.g., the engaging member 229 of FIG. 2 or 14) engaged to the enclosure and at least partially positioned in the receiving recess. As the engaging members are engaged to one of the protruding members, the enclosure may be received in the first housing while being spaced apart from an inner surface of the first case member, an inner surface of the second case member, or the support member disposed in the first housing.

According to an embodiment of the disclosure, a plurality of enclosures may be disposed in the first housing.

According to an embodiment of the disclosure, the electronic device may further comprise a second housing (e.g., the second housing 702 of FIG. 13 or 15) rotatably coupled to the first housing, and a display (e.g., the display module 160 of FIG. 1 or the display 721 or 821 of FIG. 13 or 15) having at least a portion disposed in the second housing. As the second housing rotates on the first housing, the display may be open or closed.

According to an embodiment of the disclosure, the electronic device may further comprise a second housing rotatably coupled to the first housing, and a display including a first area (e.g., the first area A1 of FIG. 15) disposed in the first housing and a second area (e.g., the second area A2 of FIG. 15) disposed in the second housing and extending from the first area. As the second housing rotates, the second area may be disposed to selectively face the first area.

According to an embodiment of the disclosure, the first housing may include at least one sound hole (e.g., the at least one sound hole 713 of FIG. 13 or 15) formed through a side wall (e.g., the side wall 701S of FIG. 13 or 15). The sound hole may be configured to radiate a sound output from the speaker unit to a portion of the first housing.

According to an embodiment of the disclosure, at least a pair of receiving recesses may be formed in a first side surface (e.g., the area facing in the +X direction of the side surface S of FIG. 3) of the enclosure. At least one receiving recess may be formed in a second side surface (e.g., the area facing in the −X direction of the side surface S of FIG. 3) of the enclosure, opposite to the first side surface.

According to an embodiment of the disclosure, the engaging member may include an extending portion engaged to the protruding member and engaging portions provided at both ends of the extending portion and engaged to the enclosure. The protruding member extends from the first case member and may include an engaging recess formed in a side surface thereof to at least partially receive the extending portion. The extending portion may be disposed to cross a direction in which the protruding member extends.

According to an embodiment of the disclosure, a speaker module (e.g., the speaker module 200 of FIG. 2 or 3) comprises at least one speaker unit, an enclosure including a first surface, a second surface facing away from the first surface, a side surface formed to at least partially surround a space between the first surface and the second surface, and a plurality of receiving recesses formed in the side surface, the enclosure receiving at least a portion of the speaker unit, and engaging members at least partially positioned in the receiving recess and engaged to the enclosure. The engaging members may be disposed to cross a direction perpendicular to the first surface or the second surface.

According to an embodiment of the disclosure, the engaging member may include an extending portion engaged to the protruding member and engaging portions provided at both ends of the extending portion and engaged to the enclosure. In a cross section cut in a direction perpendicular to a length direction of the extending portion, the extending portion may have a smaller cross-sectional area than the engaging portion.

According to an embodiment of the disclosure, the extending portion may have a cross section increasing towards the engaging portion.

According to an embodiment of the disclosure, the enclosure may include a first enclosure providing the first surface and a second enclosure providing the second surface. The second enclosure and the first enclosure may be coupled together to face each other to form the side surface.

According to an embodiment of the disclosure, the enclosure further may include a plurality of first receiving portions formed in the first enclosure, a plurality of second receiving portions formed in the second enclosure and, when the second enclosure is coupled with the first enclosure, connected to the first receiving portion to form the receiving recess, and fixing grooves formed in at least one of the first enclosure or the second enclosure and individually fixed to both sides of the receiving recess. When the engaging member may be disposed in the receiving recess, each of both ends of the engaging member may be engaged to one of the fixing grooves.

While the disclosure has been shown and described with reference to various embodiments thereof, it will be understood by those skilled in the art that various changes in form and detail may be made therein without departing from the spirit and scope of the disclosure as defined by the appended claims and their equivalents.

What is claimed is:

1. An electronic device comprising:

a case member;

a plurality of protruding members provided on the case member or a supporting member disposed on the case member;

at least one speaker;

an enclosure configured to receive at least a portion of the at least one speaker and including receiving recesses formed in side surfaces of the enclosure; and engaging members engaged to the enclosure and at least partially positioned in the receiving recesses, respectively, wherein the engaging members are at least partially received and engaged to the plurality of protruding members, respectively, to fix the enclosure to the case member or the support member disposed on the case member, wherein a lengthwise direction of each of the engaging members is substantially perpendicular to a lengthwise direction of a corresponding protruding member of the plurality of protruding members, wherein each of the engaging members includes an extending portion engaged to one of the plurality of protruding members, and engaging portions provided at both ends of the extending portion and engaged to the enclosure, and wherein in a cross section cut in a direction perpendicular to a length direction of the extending portion, the extending portion has a smaller cross-sectional area than the engaging portions.

2. The electronic device of claim 1, wherein the engaging members include at least one of silicone or rubber.

3. The electronic device of claim 1, wherein the extending portion has a circular or polygonal cross section, and the engaging portions have a polygonal shape.

4. The electronic device of claim 1, wherein the extending portion has a cross section increasing towards the engaging portions.

5. The electronic device of claim 1, wherein the enclosure includes a first surface disposed to face the case member and a second surface disposed to face away from the first surface, and wherein the side surfaces are formed to at least partially surround a space between the first surface and the second surface.

6. The electronic device of claim 5, wherein each of the plurality of protruding members is disposed inclined or perpendicular to the first surface or the second surface and is at least partially positioned in one of the receiving recesses, respectively.

7. The electronic device of claim 5, wherein each of the plurality of protruding members is disposed inclined or perpendicular to the first surface or the second surface and includes an engaging recess formed in a side surface thereof, and wherein the engaging members are received or engaged to the engaging recess of the plurality of protruding members, respectively, while being aligned in a direction crossing the plurality of protruding members.

8. The electronic device of claim 5, wherein the at least one speaker is at least partially exposed from the second surface.

9. The electronic device of claim 5, wherein the enclosure includes a first enclosure providing the first surface and a second enclosure providing the second surface, and wherein the second enclosure and the first enclosure are coupled together to face each other to form the side surfaces.

10. The electronic device of claim 9, wherein the enclosure further includes:

a plurality of first receiving portions formed in the first enclosure;

a plurality of second receiving portions formed in the second enclosure and, when the second enclosure is coupled with the first enclosure, connected to the first receiving portions to form the receiving recesses; and fixing grooves formed in at least one of the first enclosure or the second enclosure and individually provided to both sides of the receiving recesses, and wherein when the engaging members are disposed in the receiving recesses, respectively, each of both ends of the engaging members is engaged to one of the fixing grooves.

11. The electronic device of claim 1, wherein the plurality of protruding members include a metal or polymer and extend from an inner surface of the case member.

12. The electronic device of claim 1, wherein the plurality of protruding members includes a metal or polymer and extend from the support member.

13. The electronic device of claim 1, further comprising:

a first housing including the case member and a second case member coupled to face the case member, the enclosure being spaced apart from an inner surface of the case member, an inner surface of the second case member, or the support member disposed in the first housing.

14. The electronic device of claim 13, wherein a plurality of enclosures are disposed in the first housing.

15. The electronic device of claim 13, further comprising:

a second housing rotatably coupled to the first housing; and a display having at least a portion disposed in the second housing, wherein, as the second housing rotates on the first housing, the display is open or closed.

16. The electronic device of claim 13, further comprising:

a second housing rotatably coupled to the first housing; and a display including a first area disposed in the first housing and a second area disposed in the second housing and extending from the first area, wherein, as the second housing rotates, the second area is disposed to selectively face the first area.

17. The electronic device of claim 13, wherein the first housing includes at least one sound hole formed through a side wall of the first housing, and wherein the sound hole is configured to radiate a sound output from the at least one speaker to a portion of the first housing.

18. The electronic device of claim 13, wherein at least a pair of the receiving recesses are formed in a first side surface of the side surfaces, and wherein at least one of the receiving recesses is formed in a second side surface of the side surfaces, opposite to the first side surface.

19. The electronic device of claim 13, wherein each of the engaging members includes an extending portion engaged to one of the plurality of protruding members, and engaging portions provided at both ends of the extending portion and engaged to the enclosure, wherein each of the plurality of protruding members extends from the first case member and includes an engaging recess formed in a side surface thereof to at least partially receive the extending portion, and wherein the extending portion is disposed to cross a direction in which the plurality of protruding members extend.

20. A speaker enclosure comprising:

at least one speaker;

an enclosure including a first surface, a second surface facing away from the first surface, a side surface formed to at least partially surround a space between the first surface and the second surface, and receiving recesses formed in the side surface, the enclosure receiving at least a portion of the at least one speaker; and engaging members at least partially positioned in one of the receiving recesses, respectively, and engaged to the enclosure, the engaging members crossing a recess of the receiving recesses, wherein the engaging members are disposed to cross a direction perpendicular to the first surface or the second surface, wherein each of the engaging members includes an extending portion and engaging portions provided at both ends of the extending portion and engaged to the enclosure, the engaging portions oriented substantially perpendicular to the extending portion, and wherein in a cross section cut in a direction perpendicular to a length direction of the extending portion, the extending portion has a smaller cross-sectional area than the engaging portions.

21. The speaker enclosure of claim 20, wherein the extending portion has a cross section increasing towards the engaging portions.

22. The speaker enclosure of claim 20, wherein the enclosure includes a first enclosure providing the first surface and a second enclosure providing the second surface, and wherein the second enclosure and the first enclosure are coupled together to face each other to form the side surface.

23. The speaker enclosure of claim 22, wherein the enclosure further includes:

a plurality of first receiving portions formed in the first enclosure;

a plurality of second receiving portions formed in the second enclosure and, when the second enclosure is coupled with the first enclosure, connected to the first receiving portion to form the receiving recesses; and fixing grooves formed in at least one of the first enclosure or the second enclosure and individually provided to both sides of each of the receiving recesses, and wherein when an engaging member, of the engaging members, is disposed in the one of the receiving recesses, each of both ends of the engaging member is engaged to one of the fixing grooves.

24. The speaker of claim 20, wherein the engaging members include at least one of silicone or rubber.

25. The speaker enclosure of claim 20, wherein the extending portion has a circular or polygonal cross section, and the engaging portions have a polygonal shape.

* * * * *